US007534546B2

(12) United States Patent
Oguma et al.

(10) Patent No.: US 7,534,546 B2
(45) Date of Patent: May 19, 2009

(54) IMAGE-FORMING METHOD USING HEAT-SENSITIVE TRANSFER SYSTEM

(75) Inventors: Kazuaki Oguma, Minami-ashigara (JP); Takuya Arai, Minami-ashigara (JP); Yoshihisa Tsukada, Minami-ashigara (JP); Hisashi Mikoshiba, Minami-ashigara (JP); Toshihide Yoshitani, Minami-ashigara (JP); Masataka Yoshizawa, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/715,882

(22) Filed: Mar. 9, 2007

(65) Prior Publication Data

US 2007/0212637 A1 Sep. 13, 2007

(30) Foreign Application Priority Data

Mar. 9, 2006 (JP) ..... 2006-064934
Mar. 10, 2006 (JP) ..... 2006-065173

(51) Int. Cl.
*G03C 8/00* (2006.01)
*B41M 5/40* (2006.01)

(52) U.S. Cl. ..... 430/201; 428/32.39; 428/32.6; 428/32.64; 428/32.85; 428/32.86; 503/227

(58) Field of Classification Search ..... 428/32.39, 428/32.6, 32, 64, 32.85, 32.86; 430/201; 503/227

See application file for complete search history.

(56) References Cited

U.S. PATENT DOCUMENTS

| | | | | |
|---|---|---|---|---|
| 5,658,849 | A * | 8/1997 | Yamazaki et al. | 503/227 |
| 5,908,808 | A * | 6/1999 | Hanada | 503/227 |
| 7,144,672 | B2 * | 12/2006 | Okano | 430/201 |
| 7,226,891 | B2 * | 6/2007 | Nakayama et al. | 503/227 |
| 2008/0063817 | A1 * | 3/2008 | Tanaka et al. | 428/32.5 |

FOREIGN PATENT DOCUMENTS

| | | |
|---|---|---|
| JP | 9-220863 | 8/1997 |

* cited by examiner

*Primary Examiner*—Thorl Chea
(74) *Attorney, Agent, or Firm*—Sughrue Mion, PLLC

(57) ABSTRACT

An image-forming method having: superposing a heat-sensitive transfer sheet on an image-receiving sheet so that a receptor layer can be contacted with a thermal transfer layer; and providing thermal energy in accordance with image signals given from a thermal head;

in which the heat-sensitive transfer sheet is a sheet containing the thermal transfer layer that contains a colorant and at least one polyester as a binder component of the thermal transfer layer, in which at least one-second by molar ratio of the acid component of said polyester is terephtharic acid, or a sheet containing a thermal transfer layer that contains a colorant on one surface of a substrate film and a heat-resistant sliding layer formed so as to contain a hardener on the other surface of the substrate film; and the image-receiving sheet contains, on a support, the receptor layer that contains one of polyester and/or polycarbonate polymers.

8 Claims, 1 Drawing Sheet

IMAGE-FORMING METHOD USING HEAT-SENSITIVE TRANSFER SYSTEM

FIELD OF THE INVENTION

The present invention relates to an image-forming method using a thermal transfer process.

In particular, the present invention relates to an image-forming method by which a print having an excellent image quality without blur (unevenness) can be provided with no welding (fusion) between an ink sheet and an image-receiving sheet, even if a high speed printing is performed. In addition, the present invention also relates to an image-forming method by which a print having an excellent fastness of images and an excellent image quality without a failure such as blur and wrinkle can be provided with neither welding between an ink sheet and a thermal head nor welding between an ink sheet and an image-receiving sheet, even if a high speed printing is performed.

BACKGROUND OF THE INVENTION

Various heat transfer recording methods have been known so far. Among these methods, dye diffusion transfer recording systems attract attention as a process that can produce a color hard copy having an image quality closest to that of silver salt photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver salt photography: it is a dry system, it enables direct visualization from digital data, it makes reproduction simple, and the like.

In this dye diffusion transfer recording system, a heat-sensitive (thermal) transfer sheet (hereinafter also referred to as an ink sheet) containing dyes is superposed on a heat-sensitive (thermal) transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

On the other hand, an example of fields in which new applications of this dye diffusive transfer recording system are being developed, is that of heat transfer recording labels, or heat transfer recording tags, for use in POS (Point Of Sales) systems. It is relatively unusual for this system to be used in severe conditions for a long period of time, in current food label applications and cloth tag applications. However, opportunities to use this system have increased in distribution management applications such as delivery labels and air baggage tags, and it is demanded of this system to enable precise recording of, for example, bar codes, and to provide a high-quality image. Also, it is desired to improve the paper strength of heat transfer recording image-receiving paper, because there is the case in which a recording material is exposed to severe conditions.

JP-A-9-220863 ("JP-A" means unexamined published Japanese patent publication) discloses that crepe paper or extensible paper is used as a support of the image-receiving sheet. However, when this crepe paper or extensible paper is used as the support, there is the problem that moisture is absorbed in the paper during the course of the process from coating step to drying step, and also the moisture remains in the paper even after the paper is dried, causing a reduction in the sharpness of a receptor layer over time.

In the image formation that is performed using the above-described thermal transfer sheet with a thermal head, when the processing for the image formation is conducted at a high speed, and if a substrate film is a thermoplastic film such as a polyester film, problems arise that the thermal head welds the base film of an ink sheet because the thermal head has been heated at a high temperature, so that an excellent traveling of the thermal head is deteriorated, and thereby a failure such as breakage and wrinkle occurs in the thermal transfer sheet. Besides, when the processing is conducted at a high speed in the image formation, the heating time of the thermal head becomes insufficient, and the dyes transferred to the receptor layer stay in the vicinity of the surface of the receptor layer without diffusing sufficiently into the whole receptor layer. Therefore, there arises a problem that deterioration in fastness to light of images is caused.

SUMMARY OF THE INVENTION

The present invention resides in an image-forming method comprising the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals given from a thermal head, thereby to form an image;

(i) wherein the heat-sensitive transfer sheet is (a) a heat-sensitive transfer sheet comprising said thermal transfer layer that contains a thermally transferable color material and at least one polyester as a binder component of the thermal transfer layer, in which at least one-second (½) by molar ratio of the acid component of said polyester is terephtharic acid; or (b) a heat-sensitive transfer sheet comprising said thermal transfer layer that contains a thermally transferable color material on one surface of a substrate film, and a heat-resistant sliding layer that is formed so as to contain a hardener on the other surface of the substrate film; and (ii) wherein the heat-sensitive transfer image-receiving sheet comprises, on a support, said at least one receptor layer that contains at least one of polyester and/or polycarbonate polymers.

Other and further features and advantages of the invention will appear more fully from the following description, appropriately referring to the accompanying drawings.

DETAILED DESCRIPTION OF THE INVENTION

Figure 1:
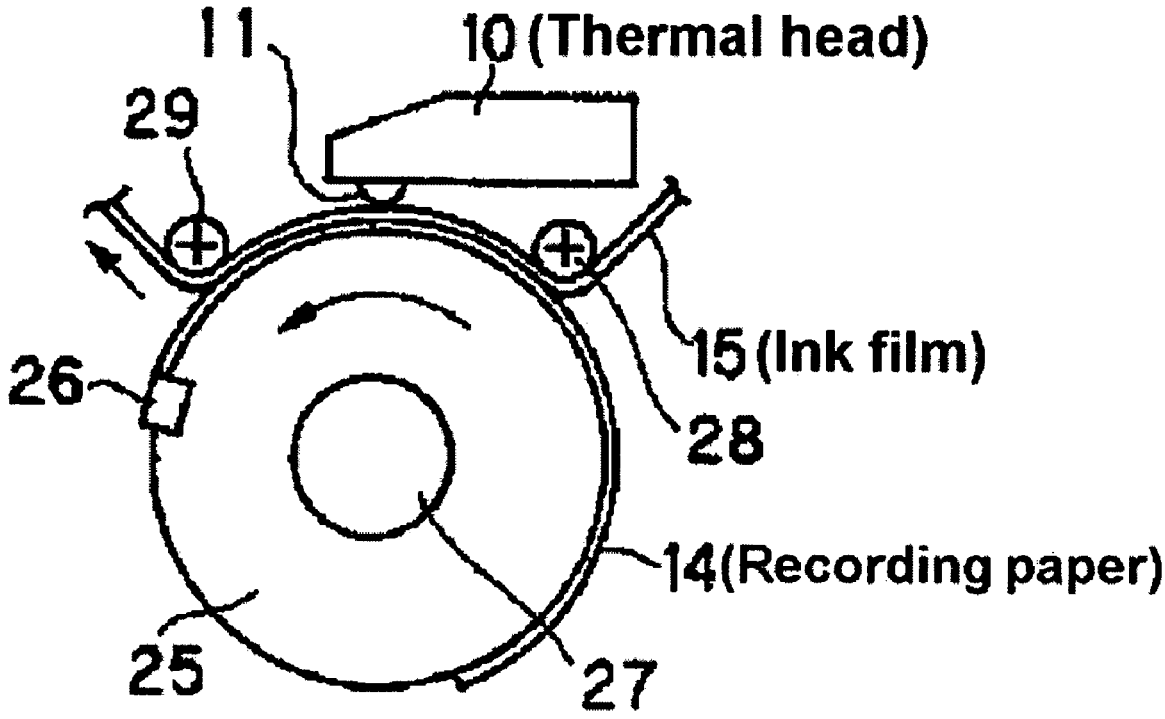
FIG. 1 is an illustration of a thermal recording apparatus that can be used for heat-sensitive transfer recording according to the present invention.

The present inventors, having studied keenly, have found that when a specific ink sheet is used, printing can be conducted at a high speed with no welding between a thermal heat and the ink sheet and no welding between the ink sheet and an image-receiving sheet. In addition, it has been found that when an image-receiving sheet containing one of polyester and/or polycarbonate polymers is used, it is possible to form an image excellent in fastness even if a high speed printing is performed. The present invention was thus attained based on these findings.

According to the present invention, there is provided the following means:

(1) An image-forming method comprising the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals given from a thermal head, thereby to form an image;

(i) wherein the heat-sensitive transfer sheet is (a) a heat-sensitive transfer sheet comprising said thermal transfer layer that contains a thermally transferable color material and at least one polyester as a binder component of the thermal transfer layer, in which at least one-second (½) by molar ratio of the acid component of said polyester is terephtharic acid; or (b) a heat-sensitive transfer sheet comprising said thermal transfer layer that contains a thermally transferable color material on one surface of a substrate film, and a heat-resistant sliding layer that is formed so as to contain a hardener on the other surface of the substrate film; and (ii) wherein the heat-sensitive transfer image-receiving sheet comprises, on a support, said at least one receptor layer that contains at least one of polyester and/or polycarbonate polymers;

(2) The image-forming method as described in the above item (1), comprising the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals given from a thermal head, thereby to form an image;

(i) wherein the heat-sensitive transfer sheet comprises said thermal transfer layer that contains a thermally transferable color material (colorant), and at least one polyester as a binder component of the thermal transfer layer, in which at least one-second (½) by molar ratio of the acid component of said polyester is terephtharic acid; and (ii) wherein the heat-sensitive transfer image-receiving sheet comprises, on a support, said at least one receptor layer that contains at least one of polyester and/or polycarbonate polymers;

(3) The image-forming method as described in the above item (2), wherein at least two-third (⅔) by molar ratio of the acid component of said polyester is terephthalic acid;

(4) The image-forming method as described in the above item (2), wherein at least three-fourth (¾) by molar ratio of the acid component of said polyester is terephthalic acid;

(5) The image-forming method as described in any one of the above items (2) to (4), wherein the heat-sensitive transfer sheet comprises at least one kind of a dye represented by formula (1) or (3):

Formula (1)

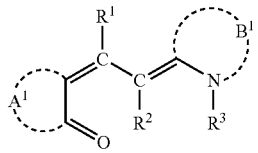

wherein, in formula (1), $R^1$, $R^2$ and $R^3$ each independently represent a hydrogen atom or a substituent; $A^1$ represents a group of atoms necessary to form a hetero ring together with the two carbon atoms; and $B^1$ represents a group of atoms necessary to form a hetero ring together with the carbon atom and the nitrogen atom; and Formula (3)

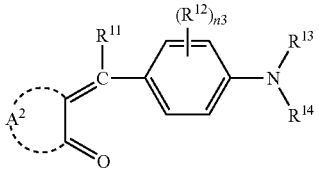

wherein, in formula (3), $R^{11}$, $R^{13}$ and $R^{14}$ each independently represent a hydrogen atom or a substituent; $R^{12}$ represents a substituent; $A^2$ represents a group of atoms necessary to form a hetero ring together with the two carbon atoms; and n3 represents an integer of 0 to 4;

(6) The image-forming method as described in any one of the above items (2) to (5), wherein the heat-sensitive transfer sheet comprises at least one kind of a dye represented by formula (4) or (5):

Formula (4)

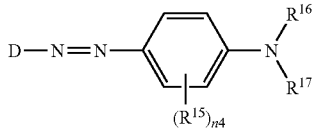

wherein, in formula (4), D represents an aromatic ring group or aromatic heterocyclic group originated from a diazonium salt; $R^{15}$ represents a substituent; $R^{16}$ and $R^{17}$ each independently represent a hydrogen atom or a substituent; and n4 represents an integer of 0 to 4; and Formula (5)

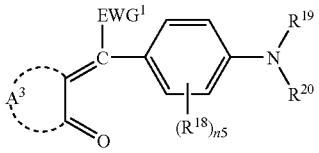

wherein, in formula (5), $A^3$ represents a group of atoms necessary to form a hetero ring together with the two carbon atoms; $EWG^1$ represents an electron-withdrawing group; $R^{18}$ represents a substituent; $R^{19}$ and $R^{20}$ each independently represent a hydrogen atom or a substituent; and n5 represents an integer of 0 to 4;

(7) The image-forming method as described in any one of the above items (2) to (6), wherein the heat-sensitive transfer sheet comprises at least one kind of a dye represented by formula (6):

Formula (6)

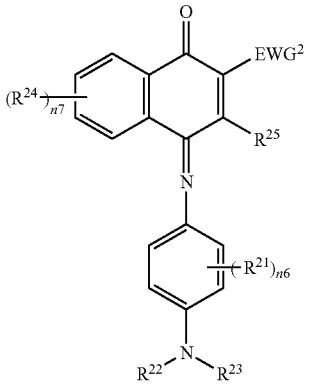

wherein, in formula (6), $EWG^2$ represents an electron-withdrawing group; $R^{21}$ and $R^{24}$ each independently represent a substituent; $R^{22}$, $R^{23}$ and $R^{25}$ each independently represent a hydrogen atom or a substituent; and n6 and n7 each independently represent an integer of 0 to 4;

(8) The image-forming method as described in any one of the above items (2) to (7), wherein a transport speed of the heat-sensitive transfer image-receiving sheet at the time of image-forming is 125 mm per second or more;

(9) The image-forming method as described in the above item (1), comprising the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals given from a thermal head, thereby to form an image;

(i) wherein the heat-sensitive transfer sheet comprises said thermal transfer layer that contains a thermally transferable color material (colorant) on one surface of a substrate film, and a heat-resistant sliding layer that is formed so as to contain a hardener on the other surface of the substrate film; and (ii) wherein the heat-sensitive transfer image-receiving sheet comprises, on a support, said at least one receptor layer that contains at least one of polyester and/or polycarbonate polymers;

(10) The image-forming method as described in the above item (9), wherein the heat-resistant sliding layer contains a polymer obtained by reacting a compound having two or more isocyanate groups with a polymer;

(11) The image-forming method as described in the above item (9) or (10), wherein a thickness of the heat-resistant sliding layer is in the range of 0.1 to 2.0 μm;

(12) The image-forming method as described in any one of the above items (9) to (11), wherein the heat-sensitive transfer sheet comprises at least one kind of a dye represented by formula (7) or (8):

Formula (7)

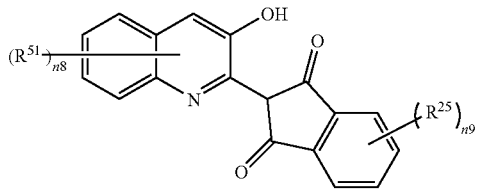

wherein, in formula (7), $R^{51}$ and $R^{52}$ each independently represent a substituent; n8 represents an integer of 0 to 5; and n9 represents an integer of 0 to 4; and Formula (8)

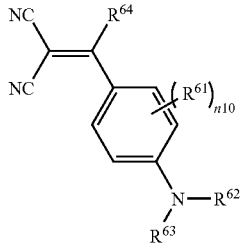

wherein, in formula (8), $R^{61}$ represents a substituent; $R^{62}$, $R^{63}$ and $R^{64}$ each independently represent a hydrogen atom or a substituent; and n10 represents an integer of 0 to 4;

(13) The image-forming method as described in any one of the above items (9) to (12), wherein the heat-sensitive transfer sheet comprises at least one kind of a dye represented by any one of formulae (9), (10) and (11):

Formula (9)

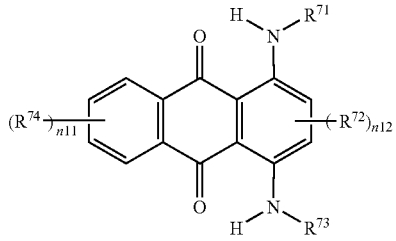

wherein, in formula (9), $R^{71}$ and $R^{73}$ each independently represent a hydrogen atom or a substituent; $R^{72}$ and $R^{74}$ each independently represent a substituent; n11 represents an integer of 0 to 4; and n12 represents an integer of 0 to 2;

Formula (10)

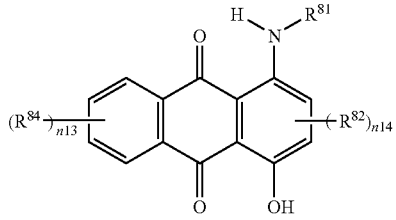

wherein, in formula (10), $R^{81}$ represents a hydrogen atom or a substituent; $R^{82}$ and $R^{84}$ each independently represent a substituent; n13 represents an integer of 0 to 4; and n14 represents an integer of 0 to 2; and Formula (11)

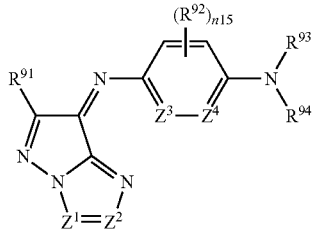

wherein, in formula (11), $R^{91}$ represents a hydrogen atom or a substituent; $R^{92}$ represents a substituent; $R^{93}$ and $R^{94}$ each independently represent a hydrogen atom or a substituent; n15 represents an integer of 0 to 2; one of $Z^1$ and $Z^2$ represents =N— and the other represents =C($R^{95}$)—; $Z^3$ and $Z^4$ each independently represent =N— or =C($R^{95}$)—; and $R^{95}$ represents a hydrogen atom or a substituent;

(14) The image-forming method as described in any one of the above items (9) to (13), wherein the heat-sensitive transfer sheet comprises at least one kind of a dye represented by formula (12) or (13):

Formula (12)

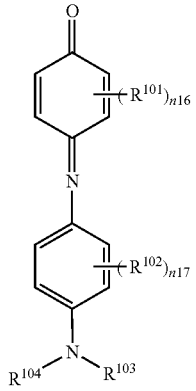

wherein, in formula (12), $R^{101}$ and $R^{102}$ each independently represent a substituent; $R^{103}$ and $R^{104}$ each independently represent a hydrogen atom or a substituent; and n16 and n17 each independently represent an integer of 0 to 4; and Formula (13)

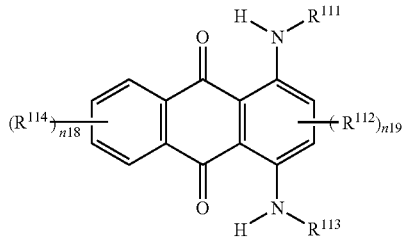

wherein, in formula (13), $R^{111}$ and $R^{113}$ each independently represent a hydrogen atom or a substituent; $R^{112}$ and $R^{114}$ each independently represent a substituent; n18 represents an integer of 0 to 4; and n19 represents an integer of 0 to 2; and

(15) The image-forming method as described in any one of the above items (9) to (14), wherein a transport speed of the heat-sensitive transfer image-receiving sheet at the time of image-forming is 125 mm per second or more.

Hereinafter, a first embodiment of the present invention means to include the image-forming methods described in the items (2) to (8) above. A second embodiment of the present invention means to include the image-forming methods described in the items (9) to (15) above.

Herein, the present invention means to include all of the above first and second embodiments, unless otherwise specified.

The present invention will be explained in detail below.

(1) Heat-Sensitive Transfer Image-Receiving Sheet

First, the heat-sensitive transfer image-receiving sheet (image-receiving sheet) is explained.

The heat-sensitive transfer image-receiving sheet used in the present invention is provided with a dye-receiving layer (receptor layer) formed on a support (substrate). It is preferable to form an undercoat layer between the receptor layer and the support. As the undercoat layer, for example, a white background control layer, a charge control layer, an adhesive layer and a primer layer are formed. Also, a heat insulation layer is preferably formed between the undercoat layer and the support. It is preferable that a curling control layer, a writing layer, or a charge-control layer be formed on the backside of the support. Each of these layers is applied using a usual method such as a roll coating, a bar coating, a gravure coating, and a gravure reverse coating.

(Receptor Layer)

The receptor layer serves to receive dyes transferred from an ink sheet and to keep an image formed by these dyes.

The image-receiving sheet for use in the present invention has at least one receptor layer containing at least one kind of polyester and/or polycarbonate polymers.

[Polymer in the Receptor Layer]

Examples of the polymer (thermoplastic resin) that may be used or additionally used in the receptor layer in the present invention include vinyl-series polymers, such as halogenated polymers (e.g., polyvinyl chloride and polyvinylidene chloride), polyvinyl acetate, ethylene-vinyl acetate copolymer, vinyl chloride-vinyl acetate copolymer, polyacryl ester, polystylene, and polystylene acrylate; acetal-series polymers, such as polyvinylformal, polyvinylbutyral and polyvinylacetal; polyester-series polymers, such as polyethylene terephthalate, polybutylene terephthalate and polycaprolactone (e.g., PLACCEL H-5 (trade name) manufactured by DAICEL CHEMICAL INDUSTRIES, LTD.); polycarbonate-series polymers; cellulose-series polymers, such as those described in JP-A-4-296595 and JP-A-2002-264543; cellulose-series polymers, such as cellulose acetate butyrate (e.g., CAB551-0.2 and CAB321-0.1 (each trade name) manufactured by Eastman Chemical Company); polyolefin-series polymers, such as polypropylene; and polyamide-series polymers, such as urea resins, melamine resins and benzoguanamine resins. These polymers may be used optionally blending with each other in the range of compatibility. Polymers used for forming the receptor layer are also disclosed in JP-A-57-169370, JP-A-57-207250 and JP-A-60-25793.

In the present invention, particularly in the first embodiment of the present invention, said at least one of polyester and/or polycarbonate polymers may be used in combination with a polyurethane or a copolymer thereof, a stylene-acrylonitrile copolymer, a polycaprolactone, or a mixture of these (co)polymers.

In the present invention, particularly in the second embodiment of the present invention, it is preferable that the polyester and/or polycarbonate polymers are used in combination with, among these polymers, a polycarbonate, a polyester, a polyurethane, a polyvinyl chloride and its copolymer, a styrene-acrylonitrile copolymer, a polycaprolactone, or a mixture of two or more of these (co)polymers. The more preferred polymer that can additionally used is a polycarbonate, a polyester, a polyvinyl chloride or its copolymer, or a mixture of two or more of these (co)polymers; and the furthermore preferred polymer that can additionally used is a polycarbonate, a polyester or a mixture of these polymers.

These polymers may be used alone or as a mixture.

The polyester and/or polycarbonate polymers are described in detail.

[Polyester Polymers]

The polyester resins (polymers) used in the receptor layer in the present invention is explained in more detail.

The polyester polymers are obtained by polycondensation of a dicarboxylic acid component (including a derivative thereof) and a diol component (including a derivative thereof). The polyester polymers preferably contain an aromatic ring and/or an aliphatic ring. As to technologies of method of producing the alicyclic polyester, those described in JP-A-5-238167 are useful from the viewpoints of ability to incorporate a dye and image stability.

Examples of the dicarboxylic acid component include isophtharic acid, trimellitic acid, terephtharic acid, 1,4-cyclohexane dicarboxylic acid, and a mixture of two or more of these acids. The dicarboxylic acid component is preferably isophtharic acid, trimellitic acid, terephtharic acid, and a mixture of two or more of these acids. From a viewpoint of improvement in fastness to light, a dicarboxylic acid component having an alicyclic structure is more preferable as the dicarboxylic acid component. The dicarboxylic acid component is further preferably 1,4-cyclohexane dicarboxylic acid or isophtharic acid. Specifically, as the dicarboxylic acid component, a mixture of isophtharic acid in an amount of 50 to 100 mol %, trimellitic acid in an amount of 0 to 1 mol %, terephtharic acid in an amount of 0 to 50 mol %, and 1,4-cyclohexane dicarboxylic acid in an amount of 0 to 15 mol %, in which a total amount of these components is 100 mol %, is furthermore preferably used.

Examples of the diol component include ethylene glycol, polyethylene glycol, tricyclodecane dimethanol, 1,4-butanediol, bisphenol, and a mixture of two or more of these diols. The diol component is preferably ethylene glycol, polyethylene glycol or tricyclodecane dimethanol. From a viewpoint of improvement in fastness to light, a diol component having an alicyclic structure is more preferable as the diol component. Use can be made of an alicyclic diol component such as cyclohexanediol, cyclohexanedimethanol and cyclohexanediethanol, in addition to tricyclodecane dimethanol. The alicyclic diol component is preferably tricyclodecane dimethanol. Specifically, as the diol component, a mixture of ethylene glycol in an amount of 0 to 50 mol %, polyethylene glycol in an amount of 0 to 10 mol %, tricyclodecane dimethanol in an amount of 0 to 90 mol % (preferably from 30 to 90 mol %, more preferably from 40 to 90 mol %), 1,4-butanediol in an amount of 0 to 50, mol %, and bisphenol A in an amount of 0 to 50 mol %, in which a total amount of these components is 100 mol %, is furthermore preferably used.

In the present invention, as the polyester polymers, it is preferably to use polyester polymers obtained by polycondensation using at least one of the above-described dicarboxylic acid component and at least one of the above-described diol component, so that the thus-obtained polyester polymers could have a molecular weight (mass average molecular weight (Mw)) of generally about 11,000 or more, preferably about 15,000 or more, and more preferably about 17,000 or more. If polyester polymers of too low molecular weight are used, elastic coefficient of the formed receptor layer becomes low and also it raises lack of thermal resistance. Resultantly, it sometimes becomes difficult to assure the releasing property of the heat-sensitive transfer sheet and the image-receiving sheet. A higher molecular weight is more preferable from a viewpoint of increase in elastic coefficient. The molecular weight is not limited in particular, so long as such failure does not occur that a higher molecular weight makes the polymer difficult to be dissolved in a solvent for a coating solution at the time of forming the receptor layer, or that an adverse effect arises in adhesive properties of the receptor layer to a substrate sheet after coating and drying the receptor layer. However, the molecular weight is preferably about 25,000 or less, and at highest a degree of about 30,000. The polyester polymers may be synthesized according to a known method.

Examples of a saturated polyester used as the polyester polymers, include VYLON 200, VYLON 290 and VYLON 600 (each trade name, manufactured by Toyobo Co., Ltd.), KA-1038C (trade name, manufactured by Arakawa Chemical Industries, Ltd.), and TP220 and TP235 (each trade name, manufactured by The Nippon Synthetic Chemical Industry Co., Ltd.).

[Polycarbonate Polymers]

The polycarbonate-series resin (polymer) used in the receptor layer in the present invention is explained in more detail.

The polycarbonate polymers mean a polyester composed of a carbonic acid and a diol as a unit. The polycarbonate polymers can be synthesized by, for example, a method in which a diol and a phosgene are reacted or a method in which a diol and a carbonic acid ester are reacted.

Examples of the diol component include bisphenol A, ethylene glycol, propylene glycol, diethylene glycol, butanediol, pentanediol, hexanediol, 1,4-cyclohexanedimethanol, nonanediol, 4,4'-bicyclo(2,2,2,)hepto-2-ylidene bisphenol, 4,4'-(octahydro-4,7-methano-5H-indene-5-ylidene) bisphenol and 2,2',6,6'-tetrachloro bisphenol A. Preferred are bisphenol A, ethylene glycol, diethylene glycol, butanediol and pentanediol. More preferred are bisphenol A, ethylene glycol and butanediol. Especially preferred are bisphenol A and ethylene glycol. As for the polycarbonate polymers used in the present invention, at least one of the above-described diol components is preferably used. A plurality of diols may be used as a mixture thereof.

The following is a detailed explanation of a bisphenol A-polycarbonate that is an especially preferred embodiment.

Technologies of unmodified polycarbonates centering the bisphenol A-polycarbonate are described in U.S. Pat. No. 4,695,286. The polycarbonate polymers used in the present invention are a polycondensation compound having a molecular weight (weight average molecular weight (Mw)) of generally about 1,000 or more, preferably about 3,000 or more, more preferably about 5,000 or more, and especially preferably about 10,000 or more. Specific examples of the polycarbonate polymers include Makrolon-5700 (trade name, manufactured by Bayer AG) and LEXAN-141 (trade name, manufactured by General Electric Corporation).

Technologies of producing modified polycarbonates by mixing bisphenol A with a diol such as ethylene glycol are described in U.S. Pat. No. 4,927,803. The polyether block unit may be produced from a linear aliphatic diol having 2 to about 10 carbon atoms. But, a polyether block unit produced from ethylene glycol is preferred. In a preferred embodiment of the present invention, the polyether block unit has a number molecular weight of about 4,000 to about 50,000, while the bisphenol A-polycarbonate block unit has a number molecular weight of about 15,000 to about 250,000. A molecular weight of the whole block copolymer is preferably in the range of about 30,000 to about 300,000. Specific examples thereof include Makrolon KL3-1013 (trade name, manufactured by Bayer AG).

It is also preferable that these unmodified and modified bisphenol A-polycarbonates are mixed together. Specifically, it is preferred to blend an unmodified bisphenol A-polycarbonate with a polyether-modified polycarbonate in a ratio by mass of from 80:20 to 10:90. The ratio by mass of from 50:50 to 40:60 is especially preferred from a viewpoint of improvement in resistance to finger print. Technologies of blending the unmodified and modified bisphenol A-polycarbonates are also described in JP-A-6-227160.

As for a preferable embodiment of the thermoplastic polymers used in the receptor layer, there can be included a blend series of the above-described polycarbonate polymers and the above-described polyester polymers. In the blend series, it is preferred to secure compatibility of the polycarbonate polymers and the polyester polymers. The polyester polymers preferably have a glass transition temperature (Tg) of about 40° C. to about 100° C., and the polycarbonate polymers preferably have a Tg of about 100° C. to about 200° C. It is preferable that the polyester polymers have a Tg lower than that of the polycarbonate polymers and act as a plasticizer to the polycarbonate polymers. A preferable Tg of a finished polyester/polycarbonate blend is in the range of 40° C. to 100° C. Even though a polyester/polycarbonate blend polymer has a higher Tg, it may be used advantageously by addition of a plasticizer.

In a further preferable embodiment, an unmodified bisphenol A-polycarbonate and polyester polymers are blended in such a ratio by mass that a Tg of the finished blend not only becomes a preferable value but also a cost can be controlled to the minimum. The polycarbonate polymers and the polyester polymers can be blended advantageously in a ratio by mass of approximately from 75:25 to 25:75. It is more preferable to blend them in a ratio by mass of from about 60:40 to about 40:60. Technologies of a blend series of the polycarbonate polymers and the polyester polymers are disclosed in JP-A-6-227161.

As for the polycarbonate polymers used in the receptor layer, a net structure of a bridged polymer may be formed in the receptor layer by reacting a polycarbonate having an average molecular weight of about 1,000 to about 10,000, the ends of which have at least 2 hydroxyl groups, with a crosslinking agent capable of reacting with the hydroxyl groups. As described in JP-A-6-155933, there can be used technologies for a crosslinking agent such as a multifunctional isocyanate, thereby to improve adhesiveness to a dye donator after transfer. Besides, as the technologies disclosed in JP-A-8-39942, there are technologies in which a receiving sheet for a heat-sensitive dye transfer process is constructed using dibutyl tin diacetate at a time of crosslinking reaction of a polycarbonate with isocyanate. Such the technologies enable to improve not only acceleration of the crosslinking reaction, but also image stability, resistance to finger print, and the like.

In the present invention, particularly in the first embodiment of the present invention, when the polycarbonate polymers for use in the receptor layer are used together with another receptor polymer, a preferred ratio of the polycarbonate polymers is in the range of from 5 mass % to 95 mass %, more preferably from 20 mass % to 90 mass %, to the whole receptor polymer.

The receptor layer for use in the present invention can be cast by extrusion coating of a melt of the polymer as recited above without resorting to solvent coating. The techniques of this extrusion coating are described in *Encyclopedia of Polymer Science and Engineering*, vol. 3, p. 563, John Wiley, New York (1985), and supra, vol. 6, p. 608 (1986). In addition, a technique for heat-sensitive dye transfer materials is disclosed in JP-A-7-179075, and it is also applicable to the present invention. As the polymer, a copolymer obtained by condensing cyclohexane dicarboxylate and a 50:50 mixture (in mol %) of ethylene glycol and bisphenol-A-diethanol (COPOL; registered trade mark) is especially preferred.

The degree of capability of being dyed is defined as follows. Four colors, specifically, yellow, magenta, cyan and black are output so as to form a solid image having 256 gradations on an image-receiving sheet, and the reflection density of the resulting image is measured to define a polymer providing an image having the highest reflection density as a receptor polymer having good capability of being dyed. It is necessary to pay special attention to the capability of being dyed of the receptor polymer because it varies depending on the type of printer and the type of ink sheet.

The glass transition temperature (Tg) of the binder used in the present invention, particularly in the second embodiment of the present invention, is preferably in the range of −30° C. to 100° C., more preferably 0° C. to 90° C., still more preferably 30° C. to 80° C. in view of film forming properties and image storability. A blend of two or more types of polymers can be used as the binder. When two or more polymers are used, the average Tg obtained by summing up the Tg of each polymer weighted by its proportion is preferably within the foregoing range. Also, when phase separation occurs or when a core-shell structure is adopted, the weighted average Tg is preferably within the foregoing range.

The glass transition temperature (Tg) is calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer ($\Sigma Xi=1$) and Tgi is glass transition temperature (measured in absolute temperature) of a homopolymer formed from the i-th monomer. The symbol Σ means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-Interscience (1989).

The emulsion polymerization method is preferably a batch polymerization method, a monomer (continuous or divided) addition method, or an emulsion addition method in view of the productivity of latex.

[Releasing Agent]

If the image-receiving surface of the heat-sensitive transfer image-receiving sheet lacks a sufficient releasing property, problems of so-called abnormal transfer arises. Examples of the abnormal transfer include a problem that a heat-sensitive transfer sheet and a heat-sensitive transfer image-receiving sheet mutually weld by heat from a thermal head for the image-forming, and thereby a big noise due to peeling arises at the time of peeling; a problem that a dye layer is entirely transferred; and a problem that the receptor layer is peeled from the support. As a method of solving such problems of releasing property, it is known that various kinds of releasing agents (lubricant) are incorporated in the receptor layer and that a releasing layer is additionally disposed on the receptor layer. In the present invention, it is preferable to use a releasing agent in the receptor layer in order to keep more securely the releasing property between the heat-sensitive transfer sheet and the image-receiving sheet at the time of printing images.

As the releasing agent, solid waxes such as polyethylene wax, amide wax and Teflon (registered trade name) powder; silicone oil, phosphate-series compounds, fluorine-based surfactants, silicone-based surfactants and others including releasing agents known in the technical fields concerned may be used. Among these, fluorine-series compounds typified by fluorine-based surfactants, silicone-based surfactants and silicone-series compounds such as silicone oil and/or its hardened products are preferably used.

In the present invention, particularly in the second embodiment of the present invention, the amount of the releasing agent is preferably 0.2 to 30 parts by mass, to the receptor polymer.

As the silicone oil, straight silicone oil and modified silicone oil or their hardened products may be used.

Examples of the straight silicone oil include dimethylsilicone oil, methylphenylsilicone oil and methyl hydrogen silicone oil. Examples of the dimethylsilicone oil include KF96-10, KF96-100, KF96-1000, KF96H-10000, KF96H-12500 and KF96H-100000 (all of these names are trade names, manufactured by Shin-Etsu Chemical Co., Ltd.). Examples of the methylphenylsilicone oil include KF50-100, KF54 and KF56 (all of these names are trade names, manufactured by Shin-Etsu Chemical Co., Ltd.).

The modified silicone oil may be classified into reactive silicone oils and non-reactive silicone oils. Examples of the reactive silicone oils include amino-modified, epoxy-modified, carboxyl-modified, hydroxy-modified, methacryl-modified, mercapto-modified, phenol-modified or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (all of these names are trade names, manufactured by Shin-Etsu Chemical Co., Ltd.). Examples of the epoxy-modified silicone oil include KF-100T, KF-101, KF-60-164, KF-103, X-22-343 and X-22-3000T (all of these names are trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (all of these names are trade names, manufactured by Shin-Etsu Chemical Co., Ltd.). Examples of the methacryl-modified silicone oil include X-22-164A, X-22-164C, X-24-8201, X-22-174D and X-22-2426 (all of these names are trade names, manufactured by Shin-Etsu Chemical Co., Ltd.).

Reactive silicone oils may be hardened upon use, and may be classified into, for example, reaction-curable type, photocurable type and catalyst-curable type. Among these types, silicone oil that is the reaction-curable type is particularly preferable. As the reaction-curable type silicone oil, products obtained by reacting an amino-modified silicone oil with an epoxy-modified silicone oil and then by curing are desirable. Also, examples of the catalyst-curable type or photocurable type silicone oil include KS-705F-PS, KS-705F-PS-1 and KS-770-PL-3 (all of these names are trade names, catalyst-curable silicone oils, manufactured by Shin-Etsu Chemical Co., Ltd.) and KS-720 and KS-774-PL-3 (all of these names are trade names, photocurable silicone oils, manufactured by Shin-Etsu Chemical Co., Ltd.). The addition amount of the curable type silicone oil is preferably 0.5 to 30% by mass based on the resin constituting the receptor layer. The releasing agent is used generally in an amount of 2 to 4% by mass and preferably 2 to 3% by mass based on 100 parts by mass of the total of the polyester and/or the polycarbonate polymers. If the amount is too small, the releasability cannot be secured without fail, whereas if the amount is excessive, a protective layer is not transferred to the image-receiving sheet resultantly.

Examples of the non-reactive silicone oil include polyether-modified, methylstyryl-modified, alkyl-modified, higher fatty acid ester-modified, hydrophilic special-modified, higher alkoxy-modified or fluorine-modified silicone oils. Examples of the polyether-modified silicone oil include KF-6012 (trade name, manufactured by Shin-Etsu Chemical Co., Ltd.) and examples of the methylstyryl-modified silicone oil include 24-510 and KF 41-410 (trade names, manufactured by Shin-Etsu Chemical Co., Ltd.). Modified silicones represented by any one of the following Formulae 11 to 13 may also be used.

Formula 11

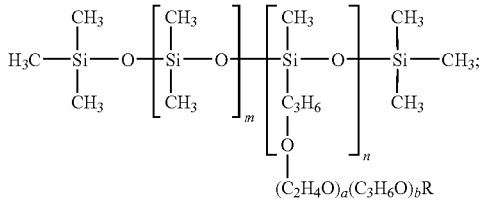

In the Formula 11, R represents a hydrogen atom or a straight-chain or branched alkyl group which may be substituted with an aryl or cycloalkyl group. m and n respectively denote an integer of 2,000 or less, and a and b respectively denote an integer of 30 or less.

Formula 12

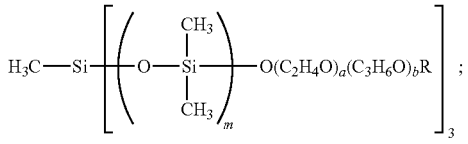

In the Formula 12, R represents a hydrogen atom or a straight-chain or branched alkyl group which may be substi tuted with an aryl or cycloalkyl group. m denotes an integer of 2,000 or less, and a and b respectively denote an integer of 30 or less.

Formula 13

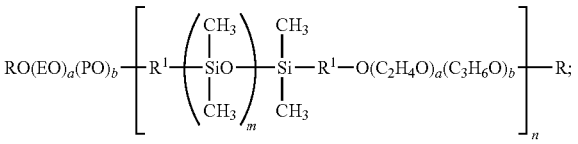

In the Formula 13, R represents a hydrogen atom or a straight-chain or branched alkyl group which may be substituted with an aryl or cycloalkyl group. $R^1$ represents a single bond or a divalent linking group, E represents an ethylene group which may be further substituted, and P represents a propylene group which may be further substituted. m and n each independently denote an integer of 2,000 or less, and a and b each independently denote an integer of 30 or less.

Silicone oils such as those mentioned above are described in "SILICONE HANDBOOK" (The Nikkan Kogyo Shimbun, Ltd.) and the technologies described in each publication of JP-A-8-108636 and JP-A-2002-264543 may be preferably used as the technologies to cure the curable type silicone oils.

In some cases, a dye binder is transferred to the receptor layer in a highlight portion of monochrome printing, to cause an irregular transfer. In addition, it is known that an addition polymerization-type silicone generally progresses a hardening reaction in the presence of a catalyst, and that almost all of complexes of transition metal of VIII group, such as Fe group and Pt group, are effective as the hardening catalyst. Among these, a platinum compound has the highest efficiency in general, and a platinum catalyst, which is generally a platinum complex soluble in the silicone oil, is preferably used. Addition amount necessary for the reaction is generally sufficiently about 1 to 100 ppm.

This platinum catalyst has a strong interaction with an organic compound containing an element such as N, P and S, an ionic compound of heavy metal such as Sn, Pb, Hg, Bi and As, or an organic compound containing a polyvalent bond such as an acetylene group. Therefore, if the above-described compounds (catalyst poison) are used together with the platinum catalyst, the ability of the catalyst to hydrosilylate is lost. Resultantly, the platinum catalyst cannot work as the hardening catalyst. Therefore, a problem arises that the platinum catalyst causes silicone to lack in hardening ability, when used with such a catalyst poison (See "Silicone Handbook" published by Nikkan Kogyo Shunbun shya). As a result, such an addition polymerization-type silicone causing such a hardening failure cannot show a releasability needed, when it is used in the receptor layer. As a hardener reacting with an active hydrogen that can be used in the present invention, particularly in the first embodiment of the present invention, it is considered to use an isocyanate compound. However, this isocyanate compound and an organic tin compound working as a catalyst to the isocyanate compound act as a catalyst poison to the platinum catalyst. Therefore, the addition polymerization-type silicone has been never used together with the isocyanate compound in the past. Resultantly, the addition polymerization-type silicone has been never used together with a modified silicone having an active hydrogen, that shows a releasability needed, when hardened with the isocyanate compound.

However, the hardening failure of the addition polymerization-type silicone can be prevented by 1) setting an equivalent amount of the reactive group of the hardener capable of reacting with the active hydrogen, to the reactive group of both the thermoplastic resin and the modified silicone having an active hydrogen, in the range of from 1:1 to 10:1, and 2) setting an addition amount of the platinum catalyst based on the addition polymerization-type silicone in the range of 100 to 10,000 ppm in terms of platinum atom of the platinum catalyst. If the equivalent amount of the reactive group of the hardener capable of reacting with the active hydrogen according to the 1) described above is too small, an amount of silicone having an active hydrogen hardened with an active hydrogen of the thermoplastic resin is so small that an excellent releasability needed cannot be achieved. On the other hand, if the equivalent ratio is too large, a time which is allowed to use an ink in a coating solution for the receptor layer is so short that such the equivalent ratio cannot be substantially applied to the present invention. Beside, if the addition amount of the platinum catalyst according to the 2) described above is too small, activity is lost by the catalyst poison, whereas if the addition amount is too large, a time which is allowed to use an ink in a coating solution for the receptor layer is so short that such the addition amount cannot be substantially applied to the present invention.

In the present invention, particularly in the first embodiment of the present invention, the amount of the receptor layer to be applied is preferably 0.5 to 10 g/m$^2$ (solid basis, hereinafter, the amount to be applied in the present specification is a value on solid basis unless otherwise noted).

(Releasing Layer)

In the present invention, particularly in the first embodiment of the present invention, in the case where the hardened modified silicone oil is not added to the receptor layer, the silicone oil may be added to a releasing layer provided on the receptor layer. In this case, the receptor layer may be provided using at least one of the above-described thermoplastic polymers. Besides, a receptor layer to which silicone is added may be used. The releasing layer contains a hardened modified silicone oil. A kind of the silicone to be used and a method of using the silicone are the same as for use in the receptor layer. Also, in the case where a catalyst or a retardant is used, addition of these additives to the receptor layer may be applied. The releasing layer may be formed using only a silicone, or alternatively a mixture of a silicone and a binder polymer having a good compatibility therewith. A thickness of the releasing layer is generally in the range of about 0.001 to about 1 g/m$^2$.

Examples of the fluorine surfactants include Fluorad FC-430 and FC-431 (trade names manufactured by 3M).

(Undercoat Layer)

An undercoat layer is preferably formed between the receptor layer and the support. As the undercoat layer, for example, a white background regulation layer, a charge regulation layer, an adhesive layer or a primer layer is formed. These layers may be formed in the same manner as those described in, for example, each specification of Japanese Patent Nos. 3,585,599 and 2,925,244.

(Heat Insulation Layer)

The heat insulation layer (foam layer) serves to protect a support from heat when a thermal head is used to carry out a transfer operation under heating. Also, because the heat insulation layer has high cushion characteristics, a thermal transfer image-receiving sheet having high printing sensitivity can be obtained even in the case of using paper as the substrate.

The heat insulation layer is generally made of a resin and a foaming agent. As the resin for the heat insulation layer, known resins such as a urethane resin, acryl resin, methacryl resin and modified olefin resin or those obtained by blending these resins may be used. Each of these resins is dissolved and/or dispersed in an organic solvent or water and the resultant is applied to form a heat insulation layer. The coating solution for the heat insulation layer is preferably an aqueous type coating solution having no influence on the foaming agent. As the coating solution, for example, a water-soluble, water-dispersible or SBR latex, emulsions including a urethane-series emulsion, polyester emulsion, emulsion of vinyl acetate and its copolymer, emulsion of a copolymer of acryl types such as acryl or acrylstyrene, vinyl chloride emulsion, or dispersions of these emulsions may be used. When a microsphere which will be explained later is used as the foaming agent, it is preferable to use an emulsion of vinyl acetate or its copolymer or an emulsion of a copolymer of acryl such as acryl or acrylstyrene.

The glass transition point, softness and filmforming characteristics of these resins can be easily controlled by changing the kind and ratio of the monomer to be copolymerized, and are therefore suitable in the point that desired characteristics are obtained even if a plasticizer and filming adjuvant are not added, that a film is reduced in a change in color when it is stored in various environments after formed, and that it is reduced in material properties with time. Also, among the above resins, the SBR latex is undesirable because it usually has a low glass transition point, tends to cause blocking and tends to be yellowed after the film is formed or while it is stored. The urethane-series emulsion is undesirable because many urethane emulsions contain solvents such as NMP and DMF and therefore tends to have an adverse influence on a foaming agent. The polyester emulsion or dispersion and the vinyl chloride emulsion are undesirable because they generally have high glass transition points, and cause a deterioration in the foaming characteristics of a microsphere. Though there are those which are soft, they are not used preferably because the softness is imparted by adding a plasticizer.

The foaming characteristics of the foaming agent are largely affected by the hardness of a resin. In order to foam the foaming agent at a desired expansion ratio, the resin is preferably those having a glass transition point of −30 to 20° C. or a minimum filmforming temperature (MFT) of 20° C. or less. Resins having a too high glass transition point lack in softness and cause a deterioration in the foaming characteristics of the foaming agent. Also, resins having a too low glass transition point give rise to blocking caused by adhesiveness (generated on the foaming layer and on the backside of the substrate when the substrate on which the foaming layer has been formed is rolled) and cause defects (for instance, when the image-receiving sheet is cut, the resin of the foaming layer adheres to a cutter blade, which deteriorates outward appearance or allows cutting dimension to be out of order). Also, resins, of which the minimum filmforming temperature is too high, cause film-forming inferiors during coating and drying, giving rise to disorders such as surface cracks.

Examples of the foaming agent include known foaming agents, for example, decomposition type foaming agents such as dinitropentamethylenetetramine, diazoaminobenzene, azobisisobutyronitrile and azodicarboamide, which are decomposed by heating to generate gases such as oxygen, hydrocarbon gas or nitrogen; and microspheres obtained by encapsulating a low-boiling point liquid such as butane and pentane with a resin such as polyvinylidene chloride or polyacrylonitrile to form a microcapsule. Among these materials, microspheres obtained by encapsulating a low-boiling point liquid such as butane and pentane with a resin such as polyvinylidene chloride or polyacrylonitrile to form a microcapsule are preferably used. These foaming agents are respectively foamed by heating after the foam layer is formed, and the resulting foamed layer has high cushion characteristics and heat insulation characteristics. The amount of the foaming agent is preferably in a range preferably from 0.5 to 100 parts by mass based on 100 parts by mass of the resin used to form the foaming layer. When the amount is too small, the cushion characteristics of the foam layer is reduced and therefore, the effect of the foam layer is not obtained. When the amount is too high, the hollow ratio of the foamed layer becomes so large that the mechanical strength of the foam layer is reduced and the foam layer cannot stand to usual handling. Also, the surface of the foam layer loses smoothness, producing an adverse effect on the outward appearance and image quality. Also, the thickness of the whole foam layer is preferably 30 to 100 μm. When the thickness is too thin, the foam layer has insufficient cushion characteristics and heat-insulation property, whereas when the thickness is too thick, the effect of the foam layer is not improved, bringing about reduced strength. Also, as to the particle diameter (size) of the foaming agent, the volume average particle diameter of the foaming agent before foaming is about 5 to 15 μm and the volume average particle diameter of the foaming agent after foaming is 20 to 50 μm. Foaming agents having a too small volume average particle diameter have a low cushion effect. Foaming agents having a too large volume average particle diameter each make the surface of the foam layer irregular, and eventually have an adverse influence on the quality of the formed image in some cases.

It is particularly preferable to use, among the above foaming agents, a low-temperature foaming type micropsphere in which the softening point of the capsule wall and foaming start temperature are respectively 100° C. or less, and which has an optimum foaming temperature (temperature at which the expansion ratio is highest when a heating time is one minute) of 140° C. or less, and to make the heating temperature as low as possible at the time of foaming. The use of a microsphere having a lower foaming temperature makes it possible to prevent thermal wrinkles and curling of the substrate at the time of foaming. This microsphere having a low foaming temperature can be obtained by controlling the amount of a thermoplastic resin such as polyvinylidene chloride and polyacrilonitrile which forms the capsule wall. The volume average particle diameter (size) is preferably 5 to 15 μm. The foam layer formed using this microsphere has the advantages that air cells obtained by foaming are closed cells, the foam layer is foamed using a simple process using only heating and the thickness of the foam layer can be easily controlled by the amount of the microsphere to be compounded.

However, this microsphere is not resistant to an organic solvent. When a coating solution containing an organic solvent is used for the foam layer, the capsule wall of the microsphere is eroded, resulting in low foaming characteristics. Therefore, when a microsphere like the above is used, it is desirable to use an aqueous type coating solution that does not contain any organic solvent, for example, ketones such as acetone and methyl ethyl ketone, esters such as ethyl acetate and lower alcohols such as methanol and ethanol which erode the capsule wall. Accordingly, it is desirable to use an aqueous type coating solution, specifically, a solution using a water-soluble or water-dispersible resin or a resin emulsion and preferably an acrylstyrene emulsion or modified vinyl acetate emulsion. Also, even if an aqueous type coating solution is used to form a foam layer, a coating solution formulated with a high-boiling point and highly polar solvent such as NMP, DMF or cellosolve as a cosolvent, a filmforming auxiliary, or a plasticizer has an adverse influence on the microsphere. It is therefore necessary to take it into account, for example, to seize the composition of the aqueous resin to be used and the amount of the high-boiling point solvent to be added, to thereby confirm whether the microcapsule is adversely affected or not.

(Support)

In the present invention, particularly in the first embodiment of the present invention, a waterproof support is preferably used as the support. The use of the waterproof support makes it possible to prevent the support from absorbing moisture, whereby a fluctuation in the performance of the receptor layer with time can be prevented. As the waterproof support, for example, coated paper or laminate paper may be used.

-Coated Paper-

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resin.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (trade names, products of Toyobo Co., Ltd.); Tafton NE-382, Tafton U-5, ATR-2009, and ATR-2010 (trade names, products of Kao Corporation); Elitel UE 3500, UE 3210, XA-8153, KZA-7049, and KZA-1449 (trade names, products of Unitika Ltd.); and Polyester TP-220 and R-188 (trade names, products of The Nippon Synthetic Chemical Industry Co., Ltd.); and thermoplastic resins in the Hyros series from Seiko Chemical Industries Co., Ltd., and the like.

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin, and (H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

-Laminated Paper-

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, both of the high-density polyethylene and the low-density polyethylene have a melt index of 1.0 to 40 g/10 minute and a high extrudability.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

As a substrate sheet (support) for use in the present invention, particularly in the second embodiment of the present invention, materials such as papers and plastic films can be also used. As the papers, any kinds of paper elements or processed papers may be used. Examples of the papers include not only a wood-free paper, a coat paper, an art paper, a cast coat paper and a paper board, but also a resin emulsion- or synthetic rubber latex-impregnated paper, and a synthetic resin-incorporated paper. Of the synthetic papers, preferably used are polystyrene-series and polyolefin-series synthetic papers.

In addition, there may be used resin films of polyolefin such as polypropylene; polyester-series resin films such as a polycarbonate film, a polyethylene naphtharate film, and a polyethylene terephtharate film; a rigid polyvinylchloride film, a polyethylene film, a polyamide film, a polyacrylonitorile film, a polymethacrylate film, a polyether-ether ketone film, a polyethersulfone film, and a polyarylate film. Various kinds of plastic film or sheet may be also used as a substrate. There can be use not only a transparent film, but also a white opaque film that is formed by adding a white pigment, a filler or the like, or a foamed film. These materials may be used solely or as a laminate that is formed by a combination with other materials.

As the substrate, a transparent substrate may be used. In this case, it is preferable in practice to use a stretched polypropylene or polyethyleneterephthalate film. These transparent substrate films can be used by loading them in OHP projectors. Further, as for a seal type, a transmissible film can be obtained without deteriorating appearance of the surface of the object to be stuck thereon. It is preferable to have transparency at the area on the thermal transfer image-receiving sheet to be stuck, such as a color material-receiving layer and an adhesive-containing layer.

Further, there can be used a substrate sheet whose surface or back surface has been subjected to a treatment for making it easily adhesive. In the present invention, particularly in the second embodiment of the present invention, the substrate sheet is not limited in particular, but it is preferable to use a plastic substrate sheet having a high electrification characteristic. A thickness of the substrate film for the thermal transfer image-receiving sheet is not limited in particular, but generally in the range of about 3 to 300 μm. In the present invention, particularly in the second embodiment of the present invention, it is preferable to use a substrate sheet having a thickness of 75 to 175 μm from a point of view such as a mechanical suitability. In the case where adhesion properties between a substrate sheet and a layer carried thereon are poor, it is preferable to subject a surface of the substrate sheet to a treatment for making it easily adhesive, or to a corona discharge treatment.

(Curling Control Layer)

When the support is exposed as it is, there is the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

(Writing Layer and Charge Controlling Layer)

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

(2) Heat-Sensitive Transfer Sheet

Next, the heat-sensitive (thermal) transfer sheet (ink sheet) for use in the present invention is explained below.

The ink sheet that is used in combination with the above-mentioned heat-sensitive transfer image-receiving sheet at the time when a thermal transfer image is formed, is provided with, on a support, a thermal transfer layer containing a diffusion transfer dye (hereinafter, also referred to as "dye layer"). The dye layer is applied using a usual method such as a roll coating, a bar coating, a gravure coating, and a gravure reverse coating.

As a substrate material of the ink sheet, plastic films are suitable such as a polyester film, a polystylene film, a polysulfone film, polyimido film, polyvinyl alcohol film, and cellophane. In a preferable embodiment of the present invention, a thermal transfer dye-providing material is composed of a cyan dye, a magenta dye and a yellow dye successively coated on a polyethylene terephthalate support. The above-described thermal transfer step is performed for each dye in success to form three color transfer image. As a matter of course, when the thermal transfer step is performed by monochrome, a monochromatic transfer image is obtained.

A polyvinyl butyral resin or a polyester resin is preferably used as a main component of the binder resin in the thermal transfer layer. In the present invention, preferably in the first embodiment of the present invention, at least one polyester is used as a main component of the binder resin in the thermal transfer layer, and at least one-second (½) by molar ratio of an acid component of said polyester is terephthalic acid. Furthermore preferably, at least two-third (⅔) by molar ratio of the acid component is terephthalic acid. Most preferably, at least three-fourth (¾) by molar ratio of the acid component is terephthalic acid. In the second embodiment of the present invention, preferred examples of a binder used in the thermal transfer sheet include cellulose resins such as ethyl cellulose, hydroxyethyl cellulose, ethyl hydroxycellulose, hydroxypropyl cellulose, methyl cellulose, cellulose acetate and cellulose butyrate; vinyl resins such as polyvinyl alcohol, polyvinyl acetate, polyvinyl butyral, polyvinyl acetal, polyvinyl pyrrolidone and polyacrylamide; polyester resins; and phenoxy resins. Among these, butyral resins and polyester resins are particularly preferable from a point of view such as a heat resistance property and a migrating property of a dye. More preferred polyester resins are those wherein at least one-second (½) by molar ratio of an acid component of said polyester is terephthalic acid. Furthermore preferably at least two-third (⅔) by molar ratio of the acid component is terephthalic acid. Most preferably at least three-fourth (¾) by molar ratio of the acid component is terephthalic acid. These resins enable to prevent the thermal transfer film from fusing to the heat-sensitive transfer image-receiving sheet. The polyester resins used in the present invention may be obtained by a method described in, for example, JPA-9-295389.

The dye layer of the ink sheet used in the present invention, particularly in the first embodiment of the present invention, preferably contains at least one dye represented by formula (1) or (3), as preferably a yellow dye. Further, it preferably contains at least one dye represented by formula (4) or (5), as preferably a magenta dye. Further, it preferably contains at least one dye represented by formula (6), as preferably a cyan dye. Furthermore, it more preferably contains at least one dye represented by formula (1) or (3) as a yellow dye, at least one dye represented by formula (4) or (5) as a magenta dye, and at least one dye represented by formula (6) as a cyan dye.

First, the dye represented by formula (I) is explained in detail.

Formula (1)

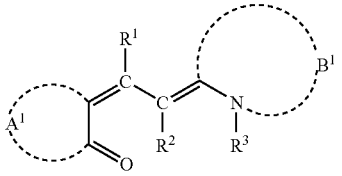

In formula (1), $R^1$, $R^2$ and $R^3$ each independently represent a hydrogen atom or a substituent.

Herein, the substituent is explained in detail. Examples of the substituent include a halogen atom, an alkyl group including a cycloalkyl group irrespective of the number of rings, an alkenyl group including a cycloalkenyl group irrespective of the number of rings, an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group including an alkylamino group and an anilino group, an acylamino group, an aminocarbonylamino group, an alkoxycarbonylamino group, an aryloxycarbonylamino group, a sulfamoylamino group, an alkyl- or arylsulfonylamino group, an alkylthio group, a sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, and an imido group. Each group may be further substituted.

Herein, $R^1$, $R^2$ and $R^3$ are described in more detail.

Examples of the halogen atom represented by $R^1$, $R^2$ and $R^3$ include a fluorine atom, a chlorine atom, a bromine atom, and an iodine atom. Among these, a chlorine atom and a bromine atom are preferably, and a chlorine atom is particularly preferable.

The alkyl group represented by $R^1$, $R^2$ and $R^3$ includes a cycloalkyl group and a bicycloalkyl group. The alkyl group also includes straight or branched chain and substituted or unsubstituted alkyl groups. The straight or branched chain and substituted or unsubstituted alkyl groups are preferably ones having 1 to 30 carbon atoms. Examples thereof include methyl, ethyl, n-propyl, isopropyl, t-butyl, n-octyl, eicosyl, 2-chloroethyl, 2-cyanoethyl and 2-ethylhexyl. The cycloalkyl group includes substituted or unsubstituted cycloalkyl groups. The substituted or unsubstituted cycloalkyl groups are preferably ones having 3 to 30 carbon atoms. Examples thereof include cyclohexyl, cyclopentyl, and 4-n-dodecylcyclohexyl. The bicycloalkyl group is preferably a substituted or unsubstituted bicycloalkyl group having from 5 to 30 carbon atoms, namely, a monovalent group resultant from removing one hydrogen atom of a bicycloalkane having from 5 to 30 carbon atoms. Examples thereof include bicyclo[1,2,2]heptane-2-yl and bicyclo[2,2,2]octane-3-yl. The alkyl group also includes alkyl groups having a multi-ring structure such as a tricyclo structure. The above-mentioned concept of the alkyl group is also applied to an alkyl moiety of the substituents (e.g., an alkyl moiety of the alkylthio group) that are explained below.

The alkenyl group represented by $R^1$, $R^2$ and $R^3$ includes a cycloalkenyl group and a bicycloalkenyl group. The alkenyl group also includes straight or branched chain or cyclic, and substituted or unsubstituted alkenyl groups. The alkenyl group is preferably a substituted or unsubstituted alkenyl group having 2 to 30 carbon atoms. Examples thereof include vinyl, allyl, prenyl, geranyl and oleyl. The cycloalkenyl group is preferably a substituted or unsubstituted cycloalkenyl group having 3 to 30 carbon atoms, namely a monovalent group resultant from removing one hydrogen atom of a cycloalkene group having 3 to 30 carbon atoms. Examples thereof include 2-cyclopentene-1-yl and 2-cyclohexene-1-yl. The bicycloalkenyl group includes a substituted or unsubstituted bicycloalkenyl group. The bicycloalkenyl group is preferably a substituted or unsubstituted bicycloalkenyl group having 5 to 30 carbon atoms, namely a monovalent group resultant from removing one hydrogen atom from a bicycloalkene having one double bond. Examples thereof include bicyclo[2,2,1]hept-2-ene-1-yl and bicyclo[2,2,2]oct-2-ene-4-yl.

The alkynyl group represented by $R^1$, $R^2$ and $R^3$ is preferably a substituted or unsubstituted alkynyl group having 2 to 30 carbon atoms. Examples thereof include ethynyl and propargyl.

The aryl group represented by $R^1$, $R^2$ and $R^3$ is preferably a substituted or unsubstituted aryl group having 6 to 30 carbon atoms. Examples thereof include phenyl, p-tolyl, naphthyl, m-chlorophenyl and o-hexadecanoylaminophenyl.

The heterocyclic group represented by $R^1$, $R^2$ and $R^3$ is preferably a monovalent group resultant from removing one hydrogen atom from a substituted or unsubstituted and aromatic or non-aromatic 5- or 6-membered heterocyclic compound. The hetero ring in the heterocyclic group may be a condensed ring. The heterocyclic group is more preferably a 5- or 6-membered aromatic heterocyclic group having 3 to 30 carbon atoms. In place of the heterocyclic group, hetero rings are exemplified below without denotation of their substitution sites: pyridine, pyrazine, pyridazine, pyrimidine, triazine, quinoline, isoquinoline, quinazoline, cinnoline, phthalazine, quinoxaline, pyrrol, indole, furan, benzofuran, thiophene, benzothiophene, pyrrazole, imidazole, benzimidazole, triazole, oxazole, benzoxazole, thiazole, benzothiazole, isothiazole, benzisothiazole, thiadiazole, isoxazole, benzoisoxazole, pyrrolidine, piperidine, piperazine, imidazolidine and thiazoline.

The alkoxy group represented by $R^1$, $R^2$ and $R^3$ includes a substituted or unsubstituted alkoxy group. The substituted or unsubstituted alkoxy group is preferably an alkoxy group having 1 to 30 carbon atoms. Examples of the alkoxy group include methoxy, ethoxy, isopropoxy, n-octyloxy, methoxyethoxy, hydroxyethoxy and 3-carboxypropoxy.

The aryloxy group represented by $R^1$, $R^2$ and $R^3$ is preferably a substituted or unsubstituted aryloxy group having 6 to 30 carbon atoms. Examples of the aryloxy group include phenoxy, 2-methylphenoxy, 4-t-butylphenoxy, 3-nitrophenoxy and 2-tetradecanoylaminophenoxy.

The acyloxy group represented by $R^1$, $R^2$ and $R^3$ is preferably a formyloxy group, a substituted or unsubstituted alkylcarbonyloxy group having 2 to 30 carbon atoms, and a substituted or unsubstituted arylcarbonyloxy group having 6 to 30 carbon atoms. Examples of the acyloxy group include formyloxy, acetyloxy, pivaloyloxy, stearoyloxy, benzoyloxy and p-methoxyphenyl carbonyloxy.

The carbamoyloxy group represented by $R^1$, $R^2$ and $R^3$ is preferably a substituted or unsubstituted carbamoyloxy group having 1 to 30 carbon atoms. Examples of the carbamoyloxy group include N,N-dimethylcarbamoyloxy, N,N-diethylcarbamoyloxy, morpholino carbonyloxy, N,N-di-n-octylaminocarbonyloxy and N-n-octylcarbamoyloxy.

The alkoxycarbonyloxy group represented by $R^1$, $R^2$ and $R^3$ is preferably a substituted or unsubstituted alkoxycarbonyloxy group having 2 to 30 carbon atoms. Examples of the alkoxycarbonyloxy group include methoxycarbonyloxy, ethoxycarbonyloxy, t-butoxycarbonyloxy and n-octylcarbonyloxy.

The aryloxycarbonyloxy group represented by $R^1$, $R^2$ and $R^3$ is preferably a substituted or unsubstituted aryloxycarbonyloxy group having 7 to 30 carbon atoms. Examples of the aryloxycarbonyloxy group include phenoxycarbonyloxy, p-methoxyphenoxycarbonyloxy and p-n-hexadecyloxyphenoxycarbonyloxy.

The amino group represented by $R^1$, $R^2$ and $R^3$ includes an alkylamino group and an arylamino group. The amino group is preferably a substituted or unsubstituted alkylamino group having 1 to 30 carbon atoms or a substituted or unsubstituted arylamino group having 6 to 30 carbon atoms. Examples of the amino group include amino, methylamino, dimethylamino, anilino, N-methyl-anilino, diphenylamino, hydroxyethylamino, carboxyethylamino, sulfoethylamino and 3,5-dicarboxyanilino.

The acylamino group represented by $R^1$, $R^2$ and $R^3$ is preferably a formylamino group, a substituted or unsubstituted alkylcarbonylamino group having 1 to 30 carbon atoms or a substituted or unsubstituted arylcarbonylamino group having 6 to 30 carbon atoms. Examples of the acylamino group include formylamino, acetylamino, pivaloylamino, lauroylamino, benzoylamino and 3,4,5-tri-n-octyloxyphenylcarbonylamino.

The aminocarbonylamino group represented by $R^1$, $R^2$ and $R^3$ is preferably a substituted or unsubstituted aminocarbonylamino group having 1 to 30 carbon atoms. Examples of the aminocarbonylamino group include carbamoylamino, N,N-dimethylaminocarbonylamino, N,N-diethylaminocarbonylamino and morpholinocarbonylamino.

The alkoxycarbonylamino group represented by $R^1$, $R^2$ and $R^3$ is preferably a substituted or unsubstituted alkoxycarbonylamino group having 2 to 30 carbon atoms. Examples of the alkoxycarbonylamino group include methoxycarbonylamino, ethoxycarbonylamino, t-butoxycarbonylamino, n-octadecyloxycarbonylamino and N-methyl-methoxycarbonylamino.

The aryloxycarbonylamino group represented by $R^1$, $R^2$ and $R^3$ is preferably a substituted or unsubstituted aryloxycarbonylamino group having 7 to 30 carbon atoms. Examples of the aryloxycarbonylamino group include phenoxycarbonylamino, p-chlorophenoxycarbonylamino and m-n-octyloxyphenoxycarbonylamino.

The sulfamoylamino group represented by $R^1$, $R^2$ and $R^3$ is preferably a substituted or unsubstituted sulfamoylamino group having 0 to 30 carbon atoms. Examples of the sulfamoylamino group include sulfamoylamino, N,N-dimethylaminosulfonylamino and N-n-octylaminosulfonylamino.

The alkyl- or aryl-sulfonylamino group represented by $R^1$, $R^2$ and $R^3$ is preferably a substituted or unsubstituted alkylsulfonylamino group having 1 to 30 carbon atoms or a substituted or unsubstituted arylsulfonylamino group having 6 to 30 carbon atoms. Examples of the alkylsulfonylamino group and the arylsulfonylamino group include methylsulfonylamino, butylsulfonylamino, phenylsulfonylamino, 2,3,5-trichlorophenylsulfonylamino and p-methylphenylsulfonylamino.

The alkylthio group represented by $R^1$, $R^2$ and $R^3$ is preferably a substituted or unsubstituted alkylthio group having 1 to 30 carbon atoms. Examples of the alkylthio group include methylthio, ethylthio and n-hexadecylthio.

The sulfamoyl group represented by $R^1$, $R^2$ and $R^3$ is preferably a substituted or unsubstituted sulfamoyl group having 0 to 30 carbon atoms. Examples of the sulfamoyl group include N-ethylsulfamoyl, N-(3-dodecyloxypropyl)sulfamoyl, N,N-dimethylsulfamoyl, N-acetylsulfamoyl, N-benzoylsulfamoyl and N—(N'-phenylcarbamoyl)sulfamoyl.

The alkyl- or aryl-sulfinyl group represented by $R^1$, $R^2$ and $R^3$ is preferably a substituted or unsubstituted alkylsulfinyl group having 1 to 30 carbon atoms or a substituted or unsubstituted arylsulfinyl group having 6 to 30 carbon atoms. Examples of the alkylsulfinyl group and the arylsulfinyl group include methylsulfinyl, ethylsulfinyl, phenylsulfinyl and p-methylphenylsulfinyl.

The alkyl- or aryl-sulfonyl group represented by $R^1$, $R^2$ and $R^3$ is preferably a substituted or unsubstituted alkylsulfonyl group having 1 to 30 carbon atoms or a substituted or unsubstituted arylsulfonyl group having 6 to 30 carbon atoms. Examples of the alkylsulfonyl group and the arylsulfonyl group include methylsulfonyl, ethylsulfonyl, phenylsulfonyl and p-toluenesulfonyl.

The acyl group represented by $R^1$, $R^2$ and $R^3$ is preferably a formyl group, a substituted or unsubstituted alkylcarbonyl group having 2 to 30 carbon atoms, a substituted or unsubstituted arylcarbonyl group having 7 to 30 carbon atoms, or a substituted or unsubstituted heterocyclic carbonyl group having 4 to 30 carbon atoms in which one of the carbon atoms in the hetero ring bonds to the carbonyl moiety. Examples of the acyl group include acetyl, pivaloyl, 2-chloroacetyl, stearoyl, benzoyl, p-n-octyloxyphenylcarbonyl, 2-pyridylcarbonyl and 2-furylcarbonyl.

The aryloxycarbonyl group represented by $R^1$, $R^2$ and $R^3$ is preferably a substituted or unsubstituted aryloxycarbonyl group having 7 to 30 carbon atoms. Examples of the aryloxycarbonyl group include phenoxycarbonyl, o-chlorophenoxycarbonyl, m-nitrophenoxycarbonyl and p-t-butylphenoxycarbonyl.

The alkoxycarbonyl group represented by $R^1$, $R^2$ and $R^3$ is preferably a substituted or unsubstituted alkoxycarbonyl group having 2 to 30 carbon atoms. Examples of the alkoxycarbonyl group include methoxycarbonyl, ethoxycarbonyl, t-butoxycarbonyl and n-octadecyloxycarbonyl.

The carbamoyl group represented by $R^1$, $R^2$ and $R^3$ is preferably a substituted or unsubstituted carbamoyl group having 1 to 30 carbon atoms. Examples of the carbamoyl group include carbamoyl, N-methylcarbamoyl, N,N-dimethylcarbamoyl, N,N-di-n-octylcarbamoyl and N-(methylsulfonyl)carbamoyl.

Examples of the aryl- or heterocyclic-azo group represented by $R^1$, $R^2$ and $R^3$ include phenylazo, 4-methoxyphenylazo, 4-pivaloylaminophenylazo and 2-hydroxy-4-propanoylphenylazo.

Examples of the imido group represented by $R^1$, $R^2$ and $R^3$ include N-succinimido and N-phthalimido.

$R^1$, $R^2$ and $R^3$ each independently preferably represent a hydrogen atom, a substituted or unsubstituted alkyl group, a substituted or unsubstituted alkenyl group, a substituted or unsubstituted aryl group, or a substituted or unsubstituted heterocyclic group; more preferably a hydrogen atom or a substituted or unsubstituted alkyl group.

$A^1$ represents a group of atoms necessary to form a hetero ring together with the carbon atoms. $A^1$ is particularly preferably a group of atoms necessary to form an acidic nucleus. The acidic nucleus is defined in James, *The Theory of the photographic Process*, Forth Edition, Macmillan (1977), page 198 and F. M. Harmer, *Heterocyclic Compounds—Cyanine Dyes and Related Compounds*, John & Wiley & Sons, New York, London (1964). $A^1$ preferably represents a group of atoms necessary to form a 5- or 6-membered nitrogen-containing hetero ring. These hetero rings may be further condensed with a ring such as benzene, benzofuran, pyridine, pyrrole, indole, and thiophene rings. Specific examples of the ring (nucleus) formed by $A^1$ include nuclei of 2-pyrazoline-5-on, pyrazolidine-3,5-dion, imidazoline-5-on, hydantoin, 2- or 4-thiohydantoin, 2-iminooxazolidine-4-on, 2-oxazoline-5-on, 2-thiooxazoline-2,4-dion, isorhodanine, rhodanine, indane-1,3-dion, thiophene-3-on, thiophene-3-on-1,1-dioxide, indoline-2-on, indoline-3-on, 2-oxoindazolium, 5,7-dioxo-6,7-dihydrothiazolo[3,2-a]pyrimidine, 3,4-dihydroisoquinoline-4-on, 1,3-dioxane-4,6-dion, barbituric acid, 2-thiobarbituric acid, coumarin-2,4-dion, indazoline-2-on, pyrido[1,2-a]pyrimidine-1,3-dion, pyrazolo[1,5-b]quinazolone, pyrazolopyridone, 3-dicyanomethylidenyl-3-phenylpropionitrile, and Meldrum's acid. A preferred nucleus is 2-pyrazoline-5-on. Each of these nuclei may be further substituted.

$B^1$ represents a group of atoms necessary to form a hetero ring together with the carbon and nitrogen atoms. $B^1$ preferably represents a group of atoms necessary to form a 5- or 6-membered nitrogen-containing hetero ring. These hetero rings may be further condensed with a ring such as benzene, benzofuran, pyridine, pyrrole, indole, and thiophene rings. Examples of the group of atoms represented by $B^1$ include ones for forming oxazole nuclei having from 3 to 25 carbon atoms (e.g., 2-3-methyloxazolyl), thiazole nuclei having from 3 to 25 carbon atoms (e.g., 2-3-methylthiazolyl), imidazole nuclei having from 3 to 25 carbon atoms (e.g., 2-1,3-diethylimidazolyl), indolenine nuclei having from 10 to 30 carbon atoms (e.g., 3,3-dimethylindolenine), quinoline nuclei having from 9 to 25 carbon atoms (e.g., 2-1-methylquinolyl), selenazole nuclei having from 3 to 25 carbon atoms (e.g., 2-3-methylbenzoselenazolyl), pyridine nuclei having from 5 to 25 carbon atoms (e.g., 2-pyridyl), thiazoline nuclei, oxazoline nuclei, selenazoline nuclei, tetrazoline nuclei, tellurazole nuclei, benzotellurazole nuclei, imidazoline nuclei, imidazo[4,5-quinoxaline] nuclei, oxadiazole nuclei, thiadiazole nuclei, tetrazole nuclei and pyrimidine nuclei. These nuclei each may be substituted.

Of the dyes represented by formula (1), a dye represented by formula (2) is preferable. The dye represented by formula (2) is explained in detail below.

Formula (2)

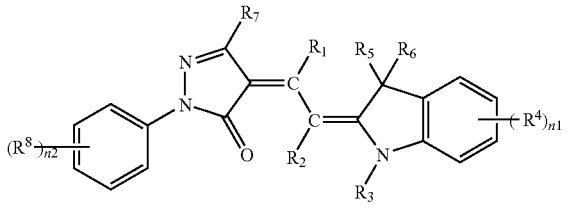

In formula (2), $R_1$, $R_2$ and $R_3$ each have the same meanings as those for $R^1$, $R^2$ and $R^3$ in formula (1), and preferred ranges of said $R_1$, $R_2$ and $R_3$ are also same. $R^4$ and $R^8$ each independently represent a substituent. $R_5$, $R_6$ and $R_7$ each independently represent a hydrogen atom or a substituent. Examples of the substituent for $R^4$, $R_5$, $R_6$, $R_7$ and $R^8$ are the same as those for $R^1$, $R^2$ and $R^3$ explained above. n1 represents an integer of 0 to 4. n2 represents an integer of 0 to 5.

$R^4$ and $R^8$ each independently preferably represent a substituted or unsubstituted alkyl group, a substituted or unsubstituted alkenyl group, a substituted or unsubstituted aryl group, or a substituted or unsubstituted heterocyclic group; more preferably a substituted or unsubstituted alkyl group.

$R_5$ and $R_6$ each independently preferably represent a hydrogen atom, a substituted or unsubstituted alkyl group, a substituted or unsubstituted alkenyl group, a substituted or unsubstituted aryl group, or a substituted or unsubstituted heterocyclic group; more preferably a hydrogen atom or a substituted or unsubstituted alkyl group.

$R_7$ preferably represents a hydrogen atom, a substituted or unsubstituted alkyl group, a substituted or unsubstituted alkenyl group, a substituted or unsubstituted aryl group, a substituted or unsubstituted heterocyclic group or a substituted or unsubstituted amino group; more preferably a hydrogen atom, a substituted or unsubstituted alkyl group or a substituted or unsubstituted amino group.

n1 is preferably an integer of 0 to 2, and more preferably an integer of 0 to 1.

n2 is preferably an integer of 0 to 3, and more preferably an integer of 0 to 1.

The following is an explanation about a preferable combination of various substituents (atoms) that a dye represented by formula (2) may have: A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

The dye represented by formula (3) is explained in detail.

Formula (3)

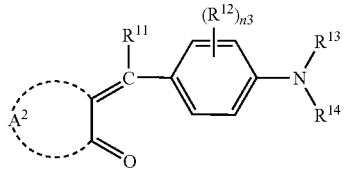

In formula (3), $R^{11}$, $R^{13}$ and $R^{14}$ each independently represent a hydrogen atom or a substituent, and $R^{12}$ represents a substituent. Examples of the substituent for $R^{11}$ to $R^{14}$ are the same as those for $R^1$, $R^2$ and $R^3$ explained above. $A^2$ represents a group of atoms necessary to form a hetero ring together with the two carbon atoms. n3 represents an integer of 0 to 4.

Preferred examples of $R^{11}$ include those for $R^1$ in formula (1). $R^{11}$ is more preferably a hydrogen atom or a substituted or unsubstituted alkyl group having 1 to 6 carbon atoms; and most preferably a hydrogen atom.

Preferred examples of $R^{12}$ include those for $R^4$ and $R^8$ in formula (2). $R^{12}$ is more preferably a substituted or unsubstituted alkyl group having 1 to 6 carbon atoms, an alkoxy group having 1 to 6 carbon atoms, or a halogen atom.

Preferred examples of $R^{13}$ and $R^{14}$ include those for $R^3$ in formula (1), and preferable ranges are also same. $R^{13}$ and $R^{14}$ are each independently more preferably a hydrogen atom, or a substituted or unsubstituted alkyl group having 1 to 6 carbon atoms.

Specific examples of $A^2$ are the same as those for $A^1$ in formula (1), and a preferable range is also same.

n3 is preferably an integer of 0 to 2, and more preferably an integer of 0 to 1.

The following is an explanation about a preferable combination of various substituents (atoms) that a dye represented by formula (3) may have: A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

The dye represented by formula (4) is explained in detail.

Formula (4)

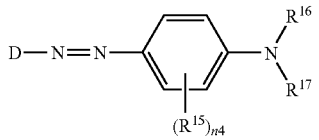

In formula (4), D represents an aromatic ring group or aromatic heterocyclic group originated from a diazonium salt; $R^{15}$ represents a substituent; and $R^{16}$ and $R^{17}$ each independently represent a hydrogen atom or a substituent. Examples of the substituent for $R^{15}$ to $R^{17}$ are the same as those for $R^1$, $R^2$ and $R^3$ explained above. n4 represents an integer of 0 to 4.

The azo dye is described in detail. The azo dye is a dye that is synthesized by reacting an aryl or heteroaryl diazonium salt (diazo component) with a compound having an acidic hydrogen atom and capable of forming a dye by a coupling reaction with the diazonium salt (coupler component).

D represents an aromatic or aromatic hetero ring capable of being derived from a diazonium salt. The aromatic or aromatic hetero ring may be further substituted. Namely, D is a diazo component. The diazo component means a partial structure that can be introduced by converting a heterocyclic compound or a benzene derivative each having an amino group as a substituent to a diazo compound (diazonium salt), and then subjecting the diazo compound to a diazo coupling reaction with a coupler. The term "diazo component" is a concept that is often used in the technical field of azo dyes. In other words, the diazo component is a monovalent substituent that is formed by removing an amino group from an aromatic heterocyclic compound or an aromatic compound each substituted with an amino group that is capable of diazotation.

The monovalent aromatic heterocyclic groups are exemplified without specifying the substitution position, namely just as a ring below. Examples of the monovalent aromatic heterocyclic group include rings of pyrrole, pyrazole, triazole, thiazole, isothiazole, benzothiazole, 1,3,4-thiadiazole, 1,2,4-thiadiazole, oxazole, benzoxazole, imidazole, benzoisothiazole, thiophene, benzothiophene, pyridine, pyridazine, pyrimidine, pyrazine, indole, quinoline, purine, carbazole, and acridine. Preferred are rings of isothiazole, 1,3,4-thiadiazole and 1,2,4-thiadiazole. Each of the above-described rings may be further substituted and/or condensed.

Examples of the monovalent aromatic group include a phenyl group and a naphthyl group. Each of these groups may have be further substituted and/or condensed.

Preferred examples of $R^{15}$ include those for $R^1$ in formula (1). $R^{15}$ is more preferably an amino group, an acylamino group, an aminocarbonylamino group, an alkoxycarbonylamino group, an aryloxycarbonylamino group, a sulfamoylamino group, or an alkyl- or aryl-sulfonylamino group.

Preferred examples of $R^{16}$ and $R^{17}$ include those for $R^3$ in formula (1), and preferable ranges are also the same as for $R^3$. $R^{16}$ and $R^{17}$ are each independently more preferably a hydrogen atom, or a substituted or unsubstituted alkyl group having 1 to 6 carbon atoms.

n4 is preferably an integer of 0 to 2, more preferably an integer of 0 to 1, and particularly preferably an integer of 1.

The following is an explanation about a preferable combination of various substituents (atoms) that a dye represented by formula (4) may have: A preferred dye is a dye in which at least one of the substituents is the above-described preferable substituent. A more preferred dye is a dye in which many various substituents are the above-described preferable substituents. The most preferred dye is a dye in which all substituents are the above-described preferable substituents.

The dye represented by formula (5) is explained in detail.

Formula (5)

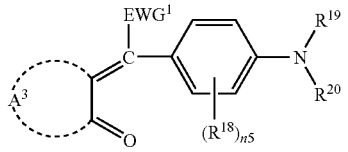

In formula (5), $A^3$ represents a group of atoms necessary to form a hetero ring together with the two carbon atoms; $EWG^1$ represents an electron-withdrawing group; $R^{18}$ represents a substituent; and $R^{19}$ and $R^{20}$ each independently represent a hydrogen atom or a substituent. Examples of the substituent for $R^{18}$ to $R^{20}$ are the same as those for $R^1$, $R^2$ and $R^3$ explained above. n5 represents an integer of 0 to 4.

Examples of $A^3$ include those for $A^1$ in formula (1), and a preferred range is also the same. $EWG^1$ represents an electron-withdrawing group having Hammett's substituent constant $\sigma_p$ value of 0 or more. Examples of the electron-withdrawing group having Hammett's substituent constant $\sigma_p$ value of 0 or more include a cyano group, a nitro group, a sulfo group, a sulfamoyl group, a carboxyl group, an alkoxycarbonyl group, a carbamoyl group, and a trifluoromethyl group. Of the electron-withdrawing groups having Hammett's substituent constant $\sigma_p$ value of 0 or more, preferred are a cyano group, a carboxyl group, an alkoxycarbonyl group, and a carbamoyl group; more preferably a cyano group, an alkoxycarbonyl group, and a carbamoyl group; and furthermore preferably a cyano group.

The expression "Hammett substituent constant $\sigma_p$ value" used herein will be briefly described. Hammett's rule is a rule of thumb advocated by L. P. Hammett in 1935 for quantitatively considering the effect of substituents on the reaction or equilibrium of benzene derivatives, and the appropriateness thereof is now widely recognized. The substituent constant determined in the Hammett's rule involves $\sigma_p$ value and $\sigma_m$ value. These values can be found in a multiplicity of general publications, and are detailed in, for example, "Lange's Handbook of Chemistry" 12th edition by J. A. Dean, 1979 (Mc Graw-Hill) and "Kagaku no Ryoiki" special issue, no. 122, pp. 96 to 103, 1979 (Nankodo). Although in the present invention, substituents are defined by the Hammett substituent constant $\sigma_p$ or described thereby, this should not be construed as limitation to only substituents whose values are known by literature and can be found in the above publications, and should naturally be construed as including substituents whose values, even if unknown by literature, would be included in stated ranges when measured according to the Hammett's rule. Further, although the compounds represented by formula (5) are not benzene derivatives, the $\sigma_p$ value is used, irrespective of the position of substitution, as a scale for evaluating the electronic effect of substituents thereof. In the present invention, the $\sigma_p$ value will be used in the above meaning below.

Preferred examples of $R^{18}$ include those as described for $R^4$ and $R^8$ in formula (2). $R^{18}$ is more preferably an alkyl group having 1 to 6 carbon atoms or an alkoxy group having 1 to 6 carbon atoms.

Preferred examples of $R^{19}$ and $R^{20}$ include those as described for $R^3$ in formula (1), and preferred ranges are also the same. $R^{19}$ and $R^{20}$ are each independently more preferably a hydrogen atom, a substituted or unsubstituted alkyl group, a substituted or unsubstituted aryl group, and a substituted or unsubstituted heterocyclic group; and furthermore preferably a hydrogen atom, or a substituted or unsubstituted alkyl group.

n5 is preferably an integer of 0 to 2, and more preferably an integer of 0 to 1.

The following is an explanation about a preferable combination of various substituents (atoms) that a dye represented by formula (5) may have: A preferred dye is a dye in which at least one of the substituents is the above-described preferable substituent. A more preferred dye is a dye in which many various substituents are the above-described preferable substituents. The most preferred dye is a dye in which all substituents are the above-described preferable substituents.

The dye represented by formula (6) is explained in detail.

Formula (6)

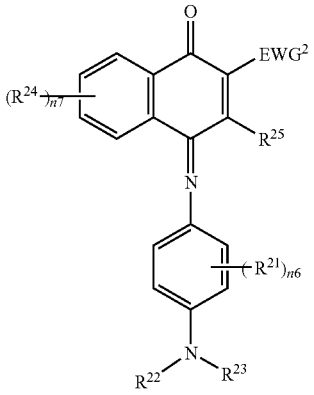

In formula (6), $EWG^2$ represents an electron-withdrawing group; $R^{21}$ and $R^{24}$ each independently represent a substituent; and $R^{22}$, $R^{23}$ and $R^{25}$ each independently represent a hydrogen atom or a substituent. Examples of the substituent for $R^{21}$ to $R^{25}$ are the same as those for $R^1$, $R^2$ and $R^3$ explained above. n6 and n7 each independently represent an integer of 0 to 4.

Specific examples of $EWG^2$ include those as for $EWG^1$ in formula (5), and a preferable range is also same. $EWG^2$ is more preferably a cyano group or a substituted or unsubstituted carbamoyl group having 1 to 6 carbon atoms, and furthermore preferably an unsubstituted carbamoyl group.

Examples of the substituent for $R^{21}$ and $R^{24}$ include those for $R^4$ and $R^8$ in formula (2) explained above, and preferable ranges are also the same. $R^{21}$ and $R^{24}$ are each independently more preferably an alkyl group having 1 to 6 carbon atoms.

Examples of the substituent for $R^{25}$ include those for $R^4$ and $R^8$ in formula (2) explained above, and a preferable range is also the same. $R^{25}$ is more preferably a hydrogen atom or an alkyl group having 1 to 6 carbon atoms, and most preferably a hydrogen atom.

Examples of the substituent for $R^{22}$ and $R^{23}$ include the substituents for $R^3$ in formula (1) explained above, and preferable ranges are also the same. $R^{22}$ and $R^{23}$ are each independently more preferably a hydrogen atom, or an alkyl group having 1 to 6 carbon atoms.

n6 is preferably an integer of 0 to 2, and more preferably an integer of 0 to 1.

n7 is preferably an integer of 0 to 2, more preferably an integer of 0 to 1, and particularly preferably an integer of 0.

The following is an explanation about a preferable combination of various substituents (atoms) that a dye represented by formula (6) may have: A preferred dye is a dye in which at least one of the substituents is the above-described preferable substituent. A more preferred dye is a dye in which many various substituents are the above-described preferable substituents. The most preferred dye is a dye in which all substituents are the above-described preferable substituents.

Specific examples of the dyes represented by formulas (1) to (6) are shown below. However, the preset invention should not be construed as being limited to the compounds set forth below.

(1)-1

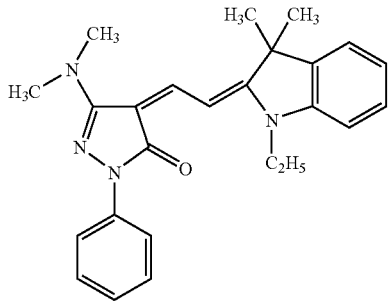

(1)-2

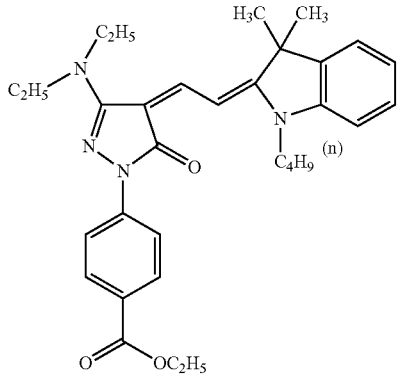

(1)-3

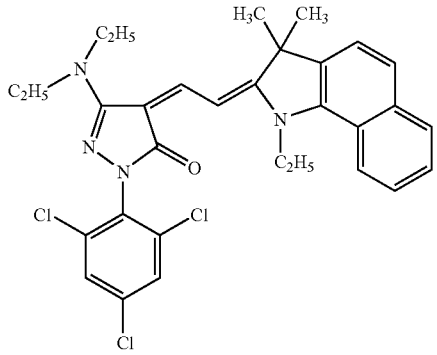

-continued
(3)-1
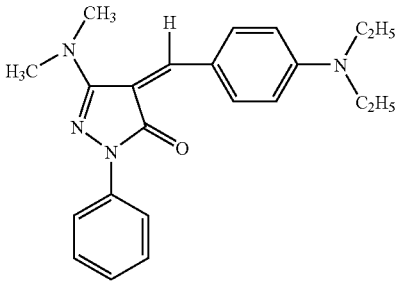
(3)-2
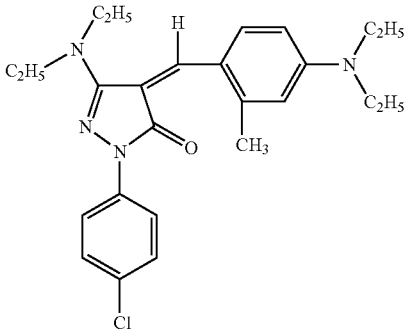
(3)-3
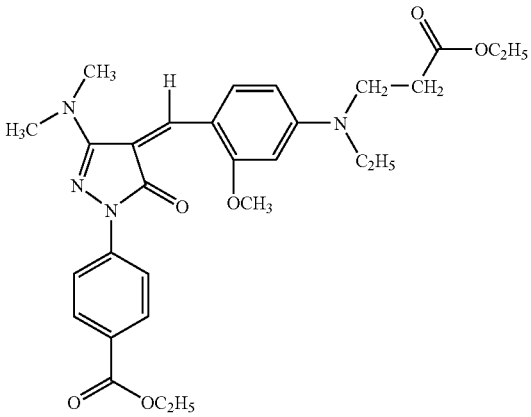
(4)-1
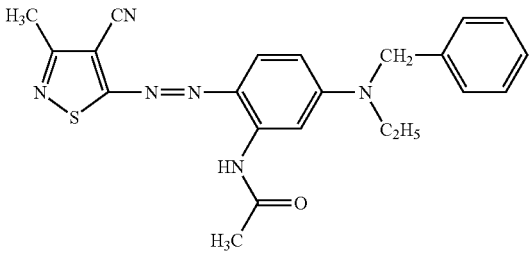
(4)-2
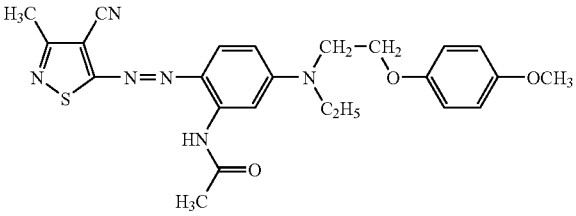
-continued
(4)-3
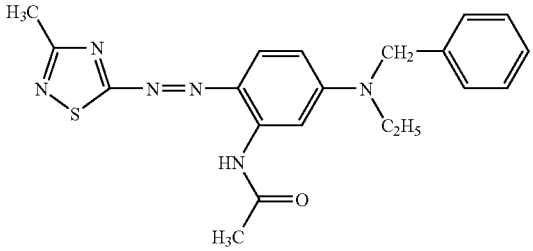
(4)-4
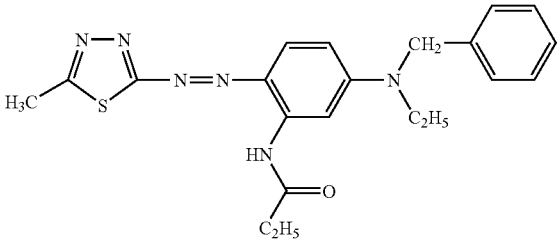
(5)-1
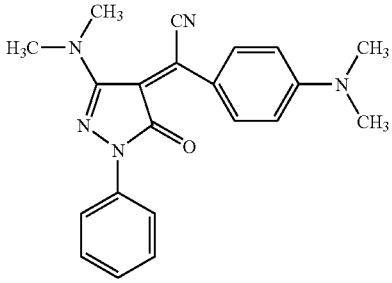
(5)-2
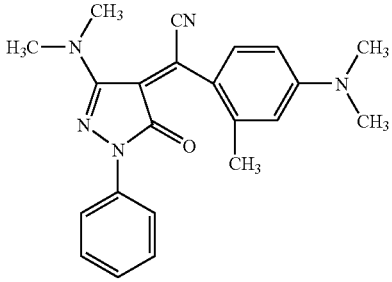
(5)-3
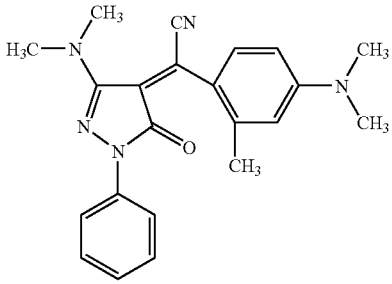

-continued (5)-4

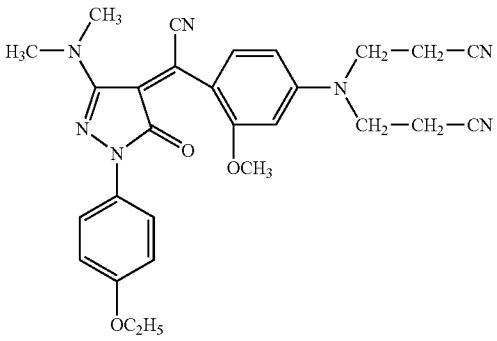

(6)-1

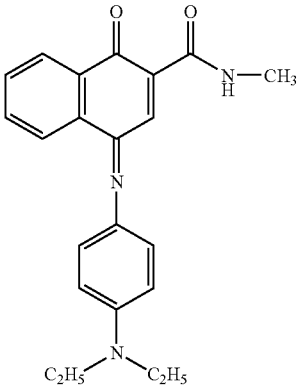

(6)-2

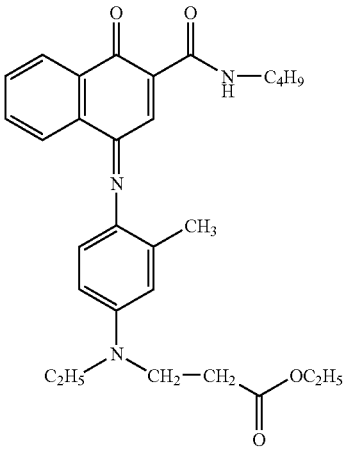

-continued (6)-3

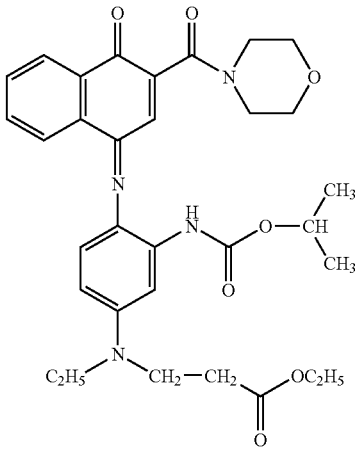

(6)-4

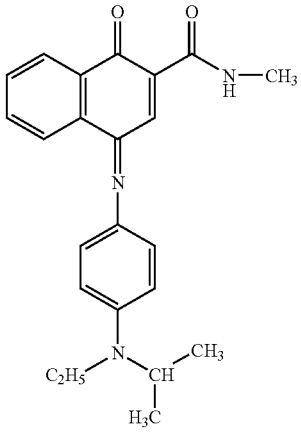

(6)-5

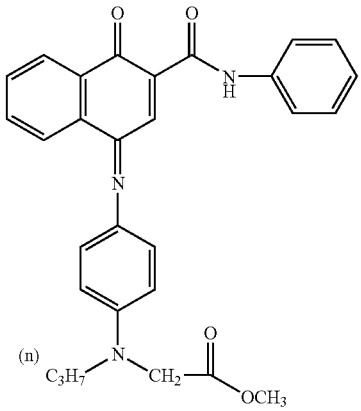

The thermal transfer layer (dye layer) of the ink sheet used in the present invention, particularly in the second embodiment of the present invention, preferably contains at least one dye represented by formula (7) or (8), as a yellow dye. Further, it preferably contains at least one dye represented by formula (9), (10) or (11), as a magenta dye. Further, it preferably contains at least one dye represented by formula (12) or (13), as a cyan dye. Furthermore, it more preferably contains at least one dye represented by formula (7) or (8) as a yellow dye, at least one dye represented by formula (9), (10) or (11) as a magenta dye, and at least one dye represented by formula (12) or (13) as a cyan dye.

First, the dye represented by formula (7) is explained in detail.

Formula (7)

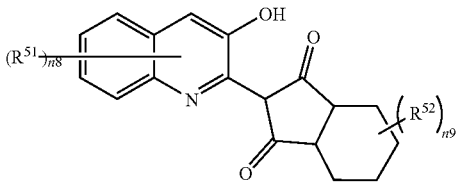

In formula (7), $R^{51}$ and $R^{52}$ each independently represent a substituent; n8 represents an integer of 0 to 5; and n9 represents an integer of 0 to 4.

In formula (7), $R^{51}$ and $R^{52}$ each independently represent a substituent. Examples of $R^{51}$ and $R^{52}$ include those for $R^1$, $R^2$ and $R^3$ explained above, and preferable ranges are also the same.

$R^{51}$ and $R^{52}$ each independently preferably represent a substituted or unsubstituted alkyl group, a substituted or unsubstituted alkenyl group, a substituted or unsubstituted aryl group, or a substituted or unsubstituted heterocyclic group; more preferably a substituted or unsubstituted alkyl group.

$R^{51}$ preferably represents a substituted or unsubstituted alkyl group, a substituted or unsubstituted alkenyl group, a substituted or unsubstituted aryl group or a substituted or unsubstituted heterocyclic group; more preferably a substituted or unsubstituted alkyl group; and further preferably a substituted or unsubstituted alkyl group having 1 to 6 carbon atoms.

$R^{52}$ preferably represents a substituted or unsubstituted alkyl group, a substituted or unsubstituted alkenyl group, a substituted or unsubstituted aryl group or a substituted or unsubstituted heterocyclic group; more preferably a substituted or unsubstituted alkyl group; more preferably an aryloxycarbonyl group having 6 to 10 carbon atoms, an alkoxycarbonyl group having 1 to 6 carbon atoms or a substituted or unsubstituted carbamoyl group; and most preferably a substituted carbamoyl group.

n8 is preferably an integer of 0 to 3; more preferably an integer of 0 to 2; and further preferably an integer of 0 or 1.

n9 is preferably an integer of 0 to 3; and more preferably an integer of 0 to 2.

The following is an explanation about a preferable combination of various substituents (atoms) that a dye represented by formula (7) may have: A preferred dye is a dye in which at least one of the substituents is the above-described preferable substituent. A more preferred dye is a dye in which many various substituents are the above-described preferable substituents. The most preferred dye is a dye in which all substituents are the above-described preferable substituents.

The dye represented by formula (8) is explained in detail.

Formula (8)

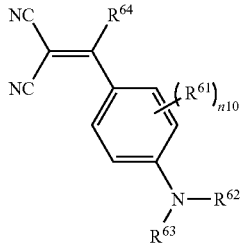

In formula (8), $R^{61}$ represents a substituent, and $R^{62}$, $R^{63}$ and $R^{64}$ each independently represent a hydrogen atom or a substituent. Examples of the substituents each represented by $R^{61}$ to $R^{64}$ include those given as examples of the substituents of the above-described $R^{51}$ and $R^{52}$. n10 represents an integer of 0 to 4.

$R^{61}$ preferably represents a substituted or unsubstituted alkyl group, a substituted or unsubstituted alkenyl group, a substituted or unsubstituted aryl group or a substituted or unsubstituted heterocyclic group; more preferably a substituted or unsubstituted alkyl group; and further preferably a substituted or unsubstituted alkyl group having 1 to 6 carbon atoms.

$R^{62}$ and $R^{63}$ each independently preferably represent a hydrogen atom, a substituted or unsubstituted alkyl group, a substituted or unsubstituted alkenyl group, a substituted or unsubstituted aryl group, or a substituted or unsubstituted heterocyclic group; more preferably a hydrogen atom or a substituted or unsubstituted alkyl group; and more preferably a hydrogen atom or a substituted or unsubstituted alkyl group having 1 to 6 carbon atoms.

$R^{64}$ preferably represents a hydrogen atom, a substituted or unsubstituted alkyl group, a substituted or unsubstituted alkenyl group, a substituted or unsubstituted aryl group or a substituted or unsubstituted heterocyclic group; more preferably a hydrogen atom or a substituted or unsubstituted alkyl group; further preferably a hydrogen atom or a substituted or unsubstituted alkyl group having 1 to 6 carbon atoms; and most preferably a hydrogen atom.

n10 is preferably an integer of 0 or 1.

The following is an explanation about a preferable combination of various substituents (atoms) that a dye represented by formula (8) may have: A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

Next, the dyes represented by formula (9) and (10) are explained in detail.

Formula (9)

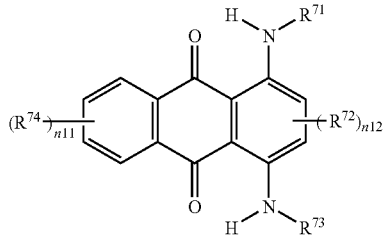

In formula (9), $R^{71}$ and $R^{73}$ each independently represent a hydrogen atom or a substituent, $R^{72}$ and $R^{74}$ each independently represent a substituent, n11 represents an integer of 0 to 4, and n12 represents an integer of 0 to 2. Examples of the substituents each represented by $R^{71}$ to $R^{74}$ include those given as examples of the substituent each represented by $R^{51}$ and $R^{52}$ set forth above.

Examples of the substituent represented by $R^{71}$ and $R^{73}$ include those given as examples of the substituents as described about $R^{51}$ in formula (7), and preferable examples thereof are also same. $R^{71}$ and $R^{73}$ each are more preferably a hydrogen atom or a substituted or unsubstituted alkyl group having 1 to 6 carbon atoms, and further preferably a hydrogen atom.

Examples of the substituent represented by $R^{72}$ and $R^{74}$ include those given as examples of the substituent as described about $R^{51}$ in formula (7). $R^{72}$ and $R^{74}$ each independently are more preferably an alkoxy group, an aryloxy group, an acyloxy group, a carbamoyloxy group, an alkoxycarbonyloxy group or an aryloxycarbonyloxy group; and further preferably an alkoxy group and an aryloxy group. Each of these groups may be further substituted.

n11 is preferably an integer of 0.

n12 is preferably an integer of 2.

Formula (10)

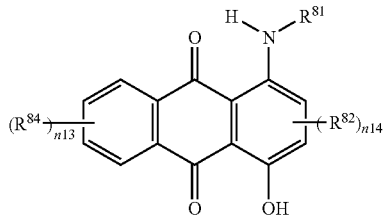

In formula (10), $R^{81}$ represents a hydrogen atom or a substituent, $R^{82}$ and $R^{84}$ each independently represent a substituent, n13 represents an integer of 0 to 4, and n14 represents an integer of 0 to 2. Examples of the substituents each represented by $R^{81}$, $R^{82}$ and $R^{84}$ include those given as examples of the substituent each represented by $R^{51}$ and $R^{52}$ set forth above.

Examples of the substituent represented by $R^{81}$ include those given as examples of the substituents as described about $R^{51}$ and $R^{52}$, and preferable examples thereof are also same. $R^{81}$ is more preferably a hydrogen atom or a substituted or unsubstituted alkyl group having 1 to 6 carbon atoms, and further preferably a hydrogen atom.

Examples of the substituent represented by $R^{82}$ and $R^{84}$ include those given as examples of the substituent as described about $R^{51}$ in formula (7). $R^{82}$ and $R^{84}$ each independently are more preferably an alkoxy group, an aryloxy group, an acyloxy group, a carbamoyloxy group, an alkoxycarbonyloxy group and an aryloxycarbonyloxy group; and further preferably an alkoxy group and an aryloxy group. Each of these groups may be further substituted.

n13 is preferably an integer of 0 or 1, and more preferably 0.

n14 is preferably an integer of 0 or 1, and more preferably an integer of 1.

The following is an explanation about a preferable combination of various substituents (atoms) that a dye represented by formula (9) or (10) may have: A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

Next, the dye represented by formula (11) is explained in detail.

Formula (11)

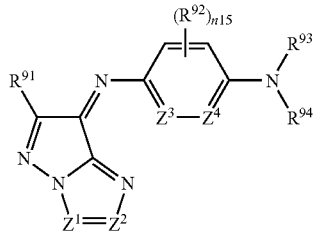

In formula (11), $R^{91}$ represents a hydrogen atom or a substituent, $R^{92}$ represents a substituent, $R^{93}$ and $R^{94}$ each independently represent a hydrogen atom or a substituent, and n15 represents an integer of 0 to 2. One of $Z^1$ and $Z^2$ represents =N— and the other represents =C($R^{95}$)—. $Z^3$ and $Z^4$ each independently represent =N— or =C($R^{95}$)—. $R^{95}$ represents a hydrogen atom or a substituent. Examples of the substituents each represented by $R^{91}$ to $R^{95}$ include those given as examples of the substituent each represented by $R^{51}$ and $R^{52}$ set forth above.

$R^{91}$ is preferably a hydrogen atom, a substituted or unsubstituted alkyl group, a substituted or unsubstituted alkenyl group, a substituted or unsubstituted aryl group, a substituted or unsubstituted heterocyclic group or a substituted or unsubstituted amino group; more preferably a substituted or unsubstituted alkyl group or a substituted or unsubstituted aryl group.

Examples of $R^{92}$ include those given as examples of the substituent as described about $R^{51}$ in formula (7), and preferable examples thereof are also the same. $R^{92}$ is more preferably a substituted or unsubstituted alkyl group.

Examples of the substituent represented by $R^{93}$ and $R^{94}$ include those given as examples of the substituents as described about $R^{51}$ and $R^{52}$, and preferable examples thereof are also same. $R^{93}$ and $R^{94}$ each are preferably a hydrogen atom and a substituted or unsubstituted alkyl group having 1 to 6 carbon atoms, and further preferably a substituted or unsubstituted alkyl group having 1 to 6 carbon atoms.

Examples of the substituent according to $R^{95}$ include those given as examples of the substituent as described about $R^{51}$ in formula (7), and preferable examples thereof are the same. $R^{95}$ is more preferably a hydrogen atom or a substituted or unsubstituted alkyl group. n15 is preferably an integer of 0.

The following is an explanation about a preferable combination of various substituents (atoms) that a dye represented by formula (11) may have: A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

Next, the dyes represented by formula (12) and (13) are explained in detail.

Formula (12)

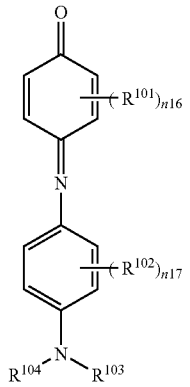

In formula (12), $R^{101}$ and $R^{102}$ each independently represent a substituent, $R^{103}$ and $R^{104}$ each independently represent a hydrogen atom or a substituent. Examples of the substituents each represented by $R^{101}$ to $R^{104}$ include those given as examples of the substituents each represented by $R^{51}$ and $R^{52}$ set forth above. n16 and n17 each independently represent an integer of 0 to 4.

Examples of $R^{101}$ include those given as examples of the substituent as described about $R^{51}$ in formula (7), and preferable examples thereof are also same. $R^{11}$ is more preferably an amino group (including an alkylamino group and an anilino group), an acylamino group, an aminocarbonylamino group, an alkoxycarbonylamino group, an aryloxycarbonylamino group, a sulfamoylamino group, or an alkyl- or arylsulfonylamino group; and further preferably an acylamino group.

Examples of $R^{102}$ include those given as examples of the substituent as described about $R^{51}$ in formula (7) and preferable examples thereof are also same. $R^{102}$ is more preferably a substituted or unsubstituted alkyl group or a substituted or unsubstituted alkoxy group.

Examples of the substituents of $R^{103}$ and $R^{104}$ include those given as examples of the substituents as described about $R^{51}$ and $R^{52}$, and preferable examples thereof are also same. $R^{103}$ and $R^{104}$ each are more preferably a substituted or unsubstituted alkyl group or a substituted or unsubstituted aryl group, and furthermore preferably a substituted or unsubstituted alkyl group.

n16 is preferably an integer of 1 to 3.

n17 is preferably an integer of 0 to 2, and more preferably an integer of 0 or 1.

Formula (13)

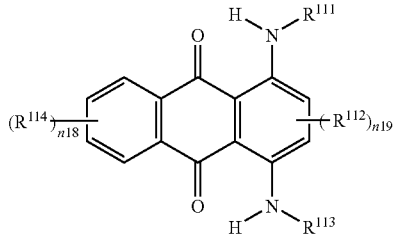

In formula (13), $R^{111}$ and $R^{113}$ each independently represent a hydrogen atom or a substituent, $R^{112}$ and $R^{114}$ each independently represent a substituent, n18 represents an integer of 0 to 4, n19 represents an integer of 0 to 2. Examples of the substituents each represented by $R^{111}$ to $R^{114}$ include those given as examples of the substituents each represented by $R^{51}$ and $R^{52}$ set forth above.

Examples of the substituent represented by $R^{111}$ and $R^{113}$ include those given as examples of the substituents as described about $R^{51}$ and $R^{52}$, and preferable examples thereof are also same. $R^{111}$ and $R^{113}$ each are more preferably a hydrogen atom, a substituted or unsubstituted alkyl group having 1 to 6 carbon atoms, or a substituted or unsubstituted aryl group.

Examples of $R^{112}$ and $R^{114}$ include substituents described about $R^{51}$ of formula (7), and a preferable range is also the same as $R^{51}$.

n18 is preferably an integer of 0.

n19 is preferably an integer of 0.

The following is an explanation about a preferable combination of various substituents (atoms) that a dye represented by formula (12) or (13) may have: A preferred compound is a compound in which at least one of the substituents is the above-described preferable substituent. A more preferred compound is a compound in which many various substituents are the above-described preferable substituents. The most preferred compound is a compound in which all substituents are the above-described preferable substituents.

Specific examples of the dyes represented by formulas (7) to (13) are shown below. However, the preset invention should not be construed as being limited to the compounds set forth below.

(7)-1
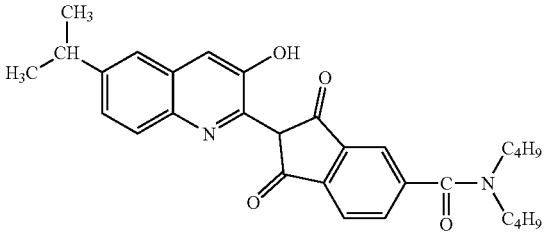
(7)-2
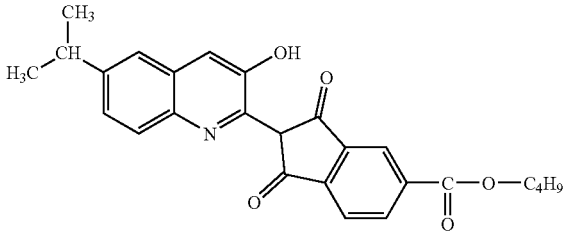
(7)-3
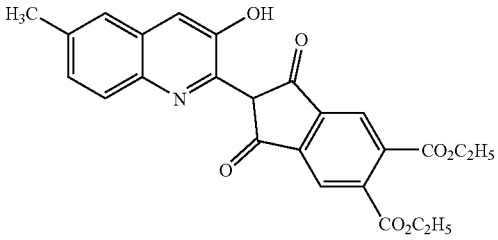
(8)-1
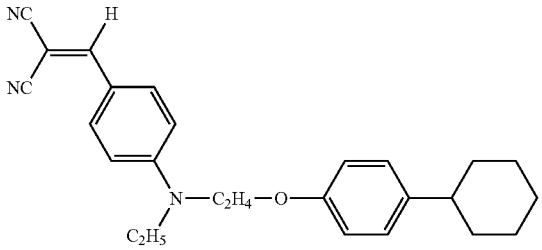
(8)-2
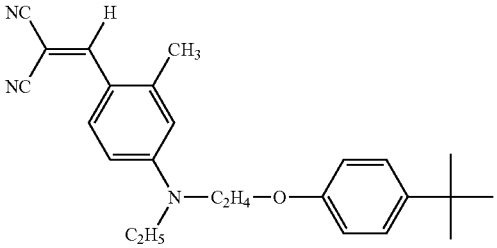
(8)-3
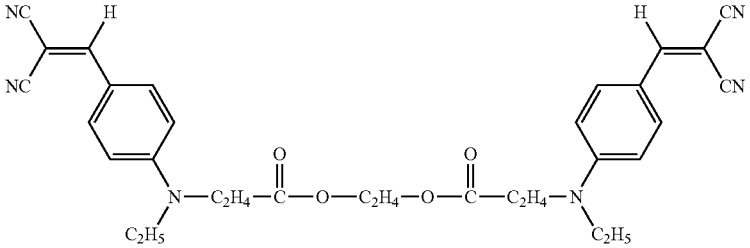
(9)-1
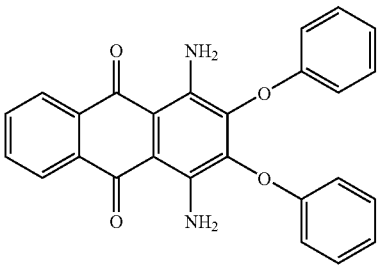
(9)-2
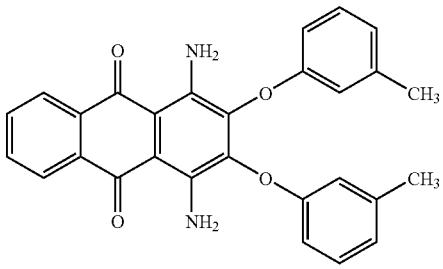
(10)-1
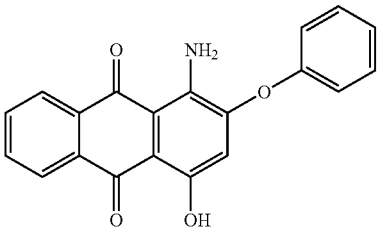
(10)-2
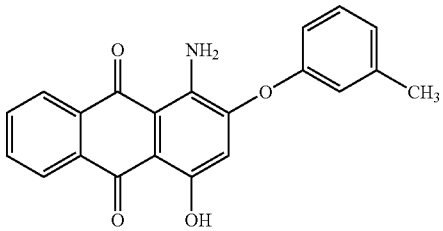

-continued
(11)-1
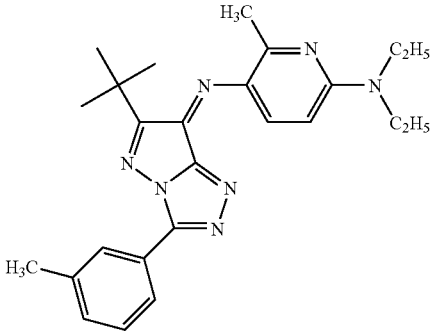
(11)-2
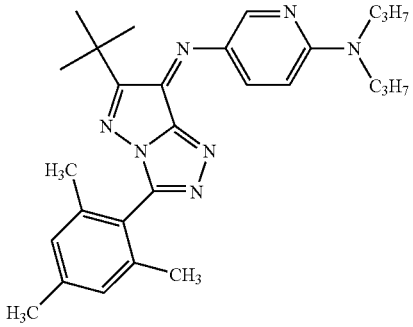
(11)-3
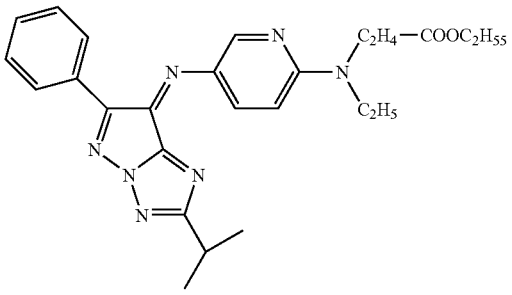
(12)-1
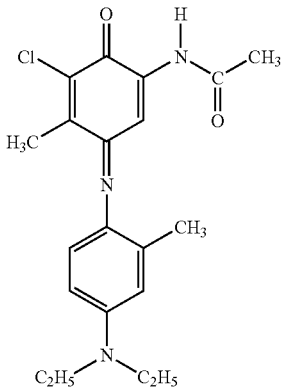
(12)-2
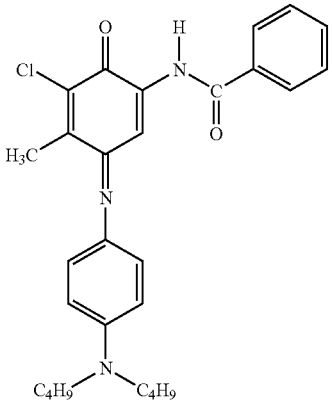
(12)-3
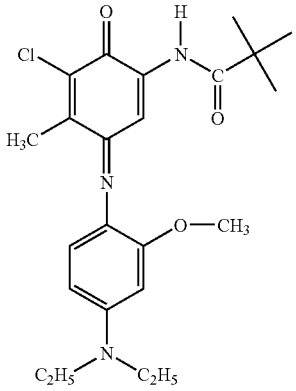
(12)-4
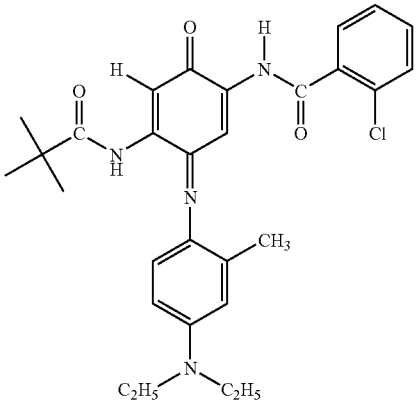
(13)-1
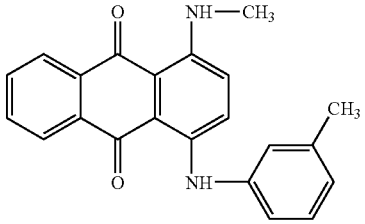

-continued (13)-2

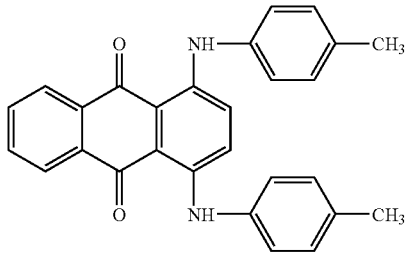

(13)-3

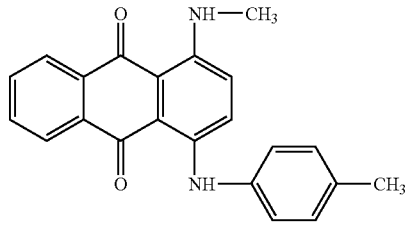

The these dyes each are contained in the thermal transfer layer (dye layer) in an amount of preferably 10 to 90 mass %, more preferably 20 to 80 mass %, based on the thermal transfer layer.

The thermal transfer layer may be coated by a conventional method such as roll coat, bar coat, gravure coat, and gravure reverse coat. A coating amount of the thermal transfer layer is preferably in the range of 0.1 to 1.0 g/m$^2$ (in solid content equivalent), and more preferably in the range of 0.15 to 0.60 g/m$^2$. Hereinafter, the term "coating amount" used herein is expressed by a solid content equivalent value, unless it is indicated differently in particular.

A film thickness of the thermal transfer layer is preferably in the range of 0.1 to 2.0 μm, and more preferably in the range of 0.1 to 1.0 μm.

In the present invention, particularly in the first embodiment of the present invention, as a support of the heat-sensitive transfer sheet, there can be used the same as for the support of the heat-sensitive transfer image-receiving sheet. For example, polyethyleneterephthalate and the like may be used.

In the present invention, particularly in the first embodiment of the present invention, a thickness of the support is preferably in the range of 1 to 10 μm, more preferably in the range of 2 to 10 μm.

A detail of the heat-sensitive transfer sheet is described in, for example, JPA-11-105437, and the descriptions of paragraph Nos. 0017 through 0078 in the publication are preferably incorporated by reference in this specification.

(Heat-Resistant Sliding Layer)

The thermal transfer film used in the present invention, preferably in the second embodiment of the present invention, has preferably a heat-resistant sliding layer that is formed so as to contain a hardener, on one surface of the substrate film (support), in order to prevent reverse affects such as a stick and printing wrinkles that are caused by heat from a thermal head. The heat-resistant sliding (lubricating) layer that is formed so as to contain a hardener, preferably contains a polymer as a binder. As the polymer, preferably used are thermoplastic resins such as polyester resins, polyacrylate resins, polyvinyl acetate resins, styrene acrylate resins, polyurethane resins, polyolefin resins, polystyrene resins, polyvinyl chloride resins, polyether resins, polyamide resins, polycarbonate resins, polyethylene resins, polypropylene resins, polyacrylamide resins, polyvinyl butyral resins, and polyvinyl acetal resins such as polyvinyl acetoacetal resins, and silicone-modified thermoplastic resins. Of these polymers, the most preferable resins are polyvinyl butyral resins, polyvinyl acetal resins such as polyvinyl acetoacetal resins, and resins having a hydroxyl group capable of reacting with an isocyanate group, such as silicone-modified resins.

In a preferred embodiment of the present invention, particularly of the second embodiment of the present invention, the above-described resins are preferably used together with a compound having 2 or more isocyanate groups as a cross-linking agent in order to give a heat-resistant sliding layer heat resistance, film coating property, and adhesion with a substrate. As these isocyanate compounds, there can be used any known isocyanate compounds that are usually employed to synthesize paints, adhesives, polyurethane and the like. For use in the present invention, particularly in the second embodiment of the present invention, these isocyanate compounds are also available by a commercial name such as Takenate (trade name, manufactured by Takeda Pharmaceutical), BURNOCK (trade name, manufactured by Dainippon Ink & Chemicals), CORONATE (trade name, manufactured by Nippon Polyurethane Industry), DURANATE (trade name, manufactured by Asahi Kasei Chemicals Corporation), and Dismodule (trade name, manufactured by Bayer).

The heat-resistant sliding layer that can be used in the present invention, particularly in the second embodiment of the present invention, is a layer that is formed so as to contain a hardener (hardening agent). Herein, the term "a (heat-resistant sliding) layer that is formed so as to contain a hardener" means that the heat-resistant sliding layer is formed by using a coating mixture which contains a hardener, or that the heat-resistant sliding layer is formed by using a coating material containing a resin crosslinked with a hardener. Preferred examples of the hardener include the cross-linking agents (including hardeners) for the receptor layer in the heat-sensitive transfer image-receiving sheet as exemplified in the above.

A preferred addition amount of said isocyanate compound is in the range of 5 to 200 parts by mass based on 100 parts by mass of a polymer binder (resin binder) that constitutes the heat-resistant sliding layer. A ratio of NCO/OH preferably ranges from about 0.8 to about 2.0. Too small content of the isocyanate compound leads to a low cross-linking density, which results in dissatisfactory thermal resistance. Whereas, if the content is too much, disadvantages arise such that (1) it becomes difficult to control shrinkage of a coating film to be formed, (2) a hardening time becomes long, and (3) an unreacted NCO group remains in the heat-resistant sliding layer, and resultantly the remaining NCO group reacts with moisture in air.

Examples of the slip characteristics-providing agent that is added to or coated on the heat-resistant sliding layer composed of the above-described resin include phosphoric acid esters, silicone oils, graphite powders, silicone-series graft polymers, and silicone polymers such as acrylosiloxane and arylsiloxanes. A preferred layer is composed of an polyol (for example, polyalcohol high molecular compound) and a polyisocyanate compound and a phosphoric acid ester compound. It is more preferable to add a filler to the layer.

When the heat-resistant sliding layer is formed using the above-described materials in the present invention, particularly in the second embodiment of the present invention, there may be incorporated thermal releasing agents or sliding agents such as wax, higher fatty acid amides, esters, and surfactants, or organic powders such as fluorine-series resins, or inorganic particles such as silica, clay, talc, and calcium carbonate in order to enhance the slip characteristics of the heat-resistant sliding layer.

The heat-resistant sliding layer is formed by the steps of: solving or dispersing the above-described materials in a suitable solvent such as acetone, methylethyl ketone, toluene, and xylene, to prepare coating liquid; coating and drying the coating liquid by a conventional coating means such as a gravure coater, a roll coater, and a wire bar; and crosslinking the coated layer according to a thermal processing. Herein, the coating amount, namely thickness of the heat-resistant sliding layer is also important. In the present invention, particularly in the second embodiment of present invention, a heat-resistant sliding layer having a satisfactory performance can be formed by controlling the amount based on a solid content in the range of preferably 2.0 g/m$^2$, or less, more preferably from 0.1 to 2.0 g/m$^2$, furthermore preferably from 0.1 to 1.0 g/m$^2$.

In the image-forming method of the present invention, imaging is achieved by superposing a heat-sensitive transfer sheet on a heat-sensitive transfer image-receiving sheet so that the thermal transfer layer of the heat-sensitive transfer sheet can be contacted with a receptor layer of the heat-sensitive transfer image-receiving sheet; and giving thermal energy in accordance with image signals given from a thermal head.

As a means for providing heat energy in the thermal transfer, any of the conventionally known providing means may be used. For example, a heat energy of about 5 to 100 mJ/mm$^2$ is applied by controlling recording time in a recording device such as a thermal printer (trade name: Video Printer VY-100, manufactured by Hitachi, Ltd.), whereby the expected object can be attained sufficiently. The image-forming method of the present invention can be achieved by the similar manner to that as described in, for example, JP-A-2005-88545.

From the viewpoint of shortening a time taken until a consumer gets a print, in the present invention, a printing time for one (1) print is preferably 8 seconds or less, and further preferably in the range of 3 to 8 seconds.

The present invention may be utilized for printers, copying machines and the like utilizing a heat-sensitive transfer recording system.

Advantages of the present invention are most effectively achieved in the case where a transport speed of the heat-sensitive transfer image-receiving sheet at the time of image formation is in the range of preferably at least 125 mm/s, more preferably from 125 mm/s to 200 mm/s, furthermore preferably from 125 mm/s to 190 mm/s, and most preferably from 125 mm/s to 175 mm/s. Herein, "mm/s" means millimeter per second. Herein, the term "transport speed" of the heat-sensitive transfer image-receiving sheet means the speed with which the heat-sensitive transfer image-receiving sheet reciprocates underneath a thermal head.

Next, a thermal printer that can be used in the thermal sublimation recording or thermal transfer recording is described in detail.

As shown in FIG. 1, for example, a thermal printer is configured so that heat-sensitive transfer recording is performed by passing electric current through an exothermic part (exothermic element array) 11 of a thermal head 10 as a heat-sensitive transfer sheet (ink film) 15 is transported in the direction of the arrow by means of transport rollers (guide rollers) 28 and 29 and the resultant heat-sensitive transfer sheet thus-used is taken up so as to be wound in a ribbon cartridge. In the thermal transfer layer of the heat-sensitive transfer sheet 15, owing to each of a yellow, a magenta and a cyan colorant layer is formed corresponding to the area of the recording surface of a heat-sensitive transfer image-receiving sheet (recording paper) 14, respectively, the heat-sensitive transfer image-receiving sheet 15 is made to reciprocate underneath the thermal head 10 by switching the transport rollers 28 and 29 between the forward and backward rotational directions, and thereby all colors are given to the surface of the recording paper 14. The term "transport speed (carrier speed)" of the thermal transfer image-receiving sheet 14 upon the image formation means the speed with which the thermal transfer image-receiving sheet reciprocates underneath the thermal head 10 (exothermic element array 11). In FIG. 1, the numeral 25 represents a platen drum, the numeral 26 represents a clamp member, and the numeral 27 represents a pulse motor.

Also, the heat-sensitive transfer image-receiving sheet for used in the present invention may be used in various applications enabling thermal transfer recording such as thin sheets or roll-like heat-sensitive transfer image-receiving sheets, cards and transmittable type manuscript-making sheets, by optionally selecting the type of support.

According to the present invention, it is possible to provide an image-forming method in which a print having an excellent image quality without blur can be obtained with no welding between a thermal transfer sheet and a heat-sensitive transfer image-receiving sheet at the time of ink-transferring, even if a high speed printing is performed.

Further, according to the present invention, it is possible to provide an image-forming method in which a print having an excellent image quality and excellent image-fastness without blur or wrinkle can be obtained with no welding between a thermal heat and an ink sheet and no welding between the ink sheet and an image-receiving sheet, even if a high speed printing is performed.

The present invention will be described in more detail based on the following examples, but the invention is not intended to be limited thereto.

EXAMPLES

In the following Examples, the terms "part" and "%" are values by mass, unless they are indicated differently in particular.

Example 1

(Production of an Ink Sheet D1)

A polyester film having 6.0 μm in thickness (trade name: Lumirror, manufactured by Toray Industries, Inc.) was used as the substrate film. A heat-resistant slip layer (thickness: 1 μm) was provided on the backside of the film, and the following yellow, magenta and cyan compositions were respectively applied as a monochromatic layer (coating amount: 1 g/m$^2$ when the layer was dried) on the front side.

The composition of each of the monochromatic ink layers was shown below.

| Yellow composition | |
|---|---|
| Dye (1)-1 | 2.2 parts |
| Dye (3)-1 | 2.3 parts |
| Polyvinylbutyral resin | 4.5 parts |
| (Trade name: DENKA BUTYRAL, manufactured by Denki Kagaku Kogyou) | |
| Methyl ethyl ketone/toluene (1/1, at mass ratio) | 90 parts |

| Magenta composition | |
|---|---|
| Dye (4)-1 | 2.2 parts |
| Dye (5)-1 | 2.3 parts |
| Polyvinylbutyral resin | 4.5 parts |
| (Trade name: DENKA BUTYRAL, manufactured by Denki Kagaku Kogyou) | |
| Methyl ethyl ketone/toluene (1/1, at mass ratio) | 90 parts |

| Cyan composition | |
|---|---|
| Dye (6)-1 | 2.2 parts |
| Dye (6)-4 | 2.3 parts |
| Polyvinylbutyral resin | 4.5 parts |
| (Trade name: DENKA BUTYRAL, manufactured by Denki Kagaku Kogyou) | |
| Methyl ethyl ketone/toluene (1/1, at mass ratio) | 90 parts |

(Production of an Ink Sheet D2)

An ink sheet D2 was produced in the same manner as in the production of the ink sheet D1, except that only each of monochromatic ink layers was replaced by the following composition.

| Yellow composition | |
|---|---|
| Dye (1)-1 | 2.2 parts |
| Dye (3)-1 | 2.3 parts |
| Polyvinylbutyral resin | 3.0 parts |
| (Trade name: DENKA BUTYRAL, manufactured by Denki Kagaku Kogyou) | |
| Polyester 4 | 1.5 parts |
| Methyl ethyl ketone/toluene (1/1, at mass ratio) | 90 parts |

| Magenta composition | |
|---|---|
| Dye (4)-1 | 2.2 parts |
| Dye (5)-1 | 2.3 parts |
| Polyvinylbutyral resin | 3.0 parts |
| (Trade name: DENKA BUTYRAL, manufactured by Denki Kagaku Kogyou) | |
| Polyester 4 | 1.5 parts |
| Methyl ethyl ketone/toluene (1/1, at mass ratio) | 90 parts |

| Cyan composition | |
|---|---|
| Dye (6)-1 | 2.2 parts |
| Dye (6)-4 | 2.3 parts |
| Polyvinylbutyral resin | 3.0 parts |
| (Trade name: DENKA BUTYRAL, manufactured by Denki Kagaku Kogyou) | |
| Polyester 4 | 1.5 parts |
| Methyl ethyl ketone/toluene (1/1, at mass ratio) | 90 parts |

(Production of an Ink Sheet D3)

An ink sheet D3 was produced in the same manner as in the production of the ink sheet D1, except that only each of monochromatic ink layers was replaced by the following composition.

| Yellow composition | |
|---|---|
| Dye (1)-1 | 2.2 parts |
| Dye (3)-1 | 2.3 parts |
| Polyvinylbutyral resin | 3.0 parts |
| (Trade name: DENKA BUTYRAL, manufactured by Denki Kagaku Kogyou) | |
| Polyester 1 | 1.5 parts |
| Methyl ethyl ketone/toluene (1/1, at mass ratio) | 90 parts |

| Magenta composition | |
|---|---|
| Dye (4)-1 | 2.2 parts |
| Dye (5)-1 | 2.3 parts |
| Polyvinylbutyral resin | 3.0 parts |
| (Trade name: DENKA BUTYRAL, manufactured by Denki Kagaku Kogyou) | |
| Polyester 1 | 1.5 parts |
| Methyl ethyl ketone/toluene (1/1, at mass ratio) | 90 parts |

| Cyan composition | |
|---|---|
| Dye (6)-1 | 2.2 parts |
| Dye (6)-4 | 2.3 parts |
| Polyvinylbutyral resin | 3.0 parts |
| (Trade name: DENKA BUTYRAL, manufactured by Denki Kagaku Kogyou) | |
| Polyester 1 | 1.5 parts |
| Methyl ethyl ketone/toluene (1/1, at mass ratio) | 90 parts |

(Production of an Ink Sheet D4)

An ink sheet D4 was produced in the same manner as in the production of the ink sheet D1, except that only each of monochromatic ink layers was replaced by the following composition.

| Yellow composition | |
|---|---|
| Dye (1)-1 | 2.2 parts |
| Dye (3)-1 | 2.3 parts |
| Polyvinylbutyral resin | 2.0 parts |
| (Trade name: DENKA BUTYRAL, manufactured by Denki Kagaku Kogyou) | |
| Polyester 2 | 2.5 parts |
| Methyl ethyl ketone/toluene (1/1, at mass ratio) | 90 parts |

| Magenta composition | |
|---|---|
| Dye (4)-1 | 2.2 parts |
| Dye (5)-1 | 2.3 parts |
| Polyvinylbutyral resin (Trade name: DENKA BUTYRAL, manufactured by Denki Kagaku Kogyou) | 2.0 parts |
| Polyester 2 | 2.5 parts |
| Methyl ethyl ketone/toluene (1/1, at mass ratio) | 90 parts |

| Cyan composition | |
|---|---|
| Dye (6)-1 | 2.2 parts |
| Dye (6)-4 | 2.3 parts |
| Polyvinylbutyral resin (Trade name: DENKA BUTYRAL, manufactured by Denki Kagaku Kogyou) | 2.0 parts |
| Polyester 2 | 2.5 parts |
| Methyl ethyl ketone/toluene (1/1, at mass ratio) | 90 parts |

(Production of an Ink Sheet D5)

An ink sheet D5 was produced in the same manner as in the production of the ink sheet D1, except that only each of monochromatic ink layers was replaced by the following composition.

| Yellow composition | |
|---|---|
| Dye (1)-1 | 2.2 parts |
| Dye (3)-1 | 2.3 parts |
| Polyvinylbutyral resin (Trade name: S-LEG BX-1 manufactured by Sekisui Chemical Co., Ltd.) | 1.5 parts |
| Polyester 3 | 3.0 parts |
| Methyl ethyl ketone/toluene (1/1, at mass ratio) | 90 parts |

| Magenta composition | |
|---|---|
| Dye (4)-1 | 2.2 parts |
| Dye (5)-1 | 2.3 parts |
| Polyvinylbutyral resin (Trade name: S-LEG BX-1 manufactured by Sekisui Chemical Co., Ltd.) | 1.5 parts |
| Polyester 3 | 3.0 parts |
| Methyl ethyl ketone/toluene (1/1, at mass ratio) | 90 parts |

| Cyan composition | |
|---|---|
| Dye (6)-1 | 2.2 parts |
| Dye (6)-4 | 2.3 parts |
| Polyvinylbutyral resin (Trade name: S-LEC BX-1 manufactured by Sekisui Chemical Co., Ltd.) | 1.5 parts |
| Polyester 3 | 3.0 parts |
| Methyl ethyl ketone/toluene (1/1, at mass ratio) | 90 parts |

(Production of an Ink Sheet D6)

An ink sheet D6 was produced in the same manner as in the production of the ink sheet D1, except that only each of monochromatic ink layers was replaced by the following composition.

| Yellow composition | |
|---|---|
| Dye (1)-1 | 2.2 parts |
| Dye (3)-1 | 2.3 parts |
| Polyester 3 | 4.5 parts |
| Methyl ethyl ketone/toluene (1/1, at mass ratio) | 90 parts |

| Magenta composition | |
|---|---|
| Dye (4)-1 | 2.2 parts |
| Dye (5)-1 | 2.3 parts |
| Polyester 3 | 4.5 parts |
| Methyl ethyl ketone/toluene (1/1, at mass ratio) | 90 parts |

| Cyan composition | |
|---|---|
| Dye (6)-1 | 2.2 parts |
| Dye (6)-4 | 2.3 parts |
| Polyester 3 | 4.5 parts |
| Methyl ethyl ketone/toluene (1/1, at mass ratio) | 90 parts |

The composition of each of the above-described polyesters 1 to 4 is set forth below.

(Polyester 1)

Polyester having a number-average molecular weight of 3,000, that was obtained by polymerizing the following molar ratio of acid and diol components as described below.

| | |
|---|---|
| Isophthalic acid | 25 |
| Terephthalic acid | 25 |
| Ethyleneglycol | 5 |
| Diethyleneglycol | 45 |

(Polyester 2)

Polyester having a number-average molecular weight of 2,000, that was obtained by polymerizing the following molar ratio of acid and diol components as described below.

| | |
|---|---|
| Isophthalic acid | 10 |
| Terephthalic acid | 40 |
| Ethyleneglycol | 5 |
| Diethyleneglycol | 45 |

(Polyester 3)

Polyester having a number-average molecular weight of 2,000, that was obtained by polymerizing the following molar ratio of acid and diol components as described below.

| | |
|---|---|
| Isophthalic acid | 5 |
| Terephthalic acid | 45 |

-continued

| | |
|---|---|
| Ethyleneglycol | 5 |
| Diethyleneglycol | 45 |

(Polyester 4) Polyester having a number-average molecular weight of 2,000, that was obtained by polymerizing the following molar ratio of acid and diol components as described below.

| | |
|---|---|
| Isophthalic acid | 45 |
| Terephthalic acid | 5 |
| Ethyleneglycol | 5 |
| Diethyleneglycol | 45 |

(Production of an Image-Receiving Sheet R1)

Synthetic paper (trade name: Yupo FPG 200, manufactured by Yupo Corporation, thickness: 200 μm) was used as the support; and, on one surface of the support, a white intermediate layer and a receptor layer having the following compositions were coated in this order by a bar coater. The coating was carried out such that the amount of the white intermediate layer and the amount of the receptor layer after each layer was dried were 1.0 g/m$^2$ and 4.0 g/m$^2$, and these layers were respectively dried at 110° C. for 30 seconds.

| White intermediate layer | |
|---|---|
| Polyester resin (Trade name: Vylon 200, manufactured by Toyobo Co., Ltd.) | 10 parts by mass |
| Fluorescent whitening agent (Trade name: Uvitex OB, manufactured by Ciba Specialty Chemicals) | 1 part by mass |
| Titanium oxide | 30 parts by mass |
| Methyl ethyl ketone/toluene (1/1, at mass ratio) | 90 parts by mass |

| Receptor layer | |
|---|---|
| Polyester resin (Trade name: Vylon 600, manufactured by Toyobo Co., Ltd.) | 100 parts by mass |
| Amino-modified silicone (Trade name: X22-3050C, manufactured by Shin-Etsu Chemical Co., Ltd.) | 5 parts by mass |
| Epoxy-modified silicone (Trade name: X22-3000E, manufactured by Shin-Etsu Chemical Co., Ltd.) | 5 parts by mass |
| Methyl ethyl ketone/toluene (1/1, at mass ratio) | 400 parts by mass |

(Production of an Image-Receiving Sheet R2)

An image-receiving sheet R2 was produced in the same manner as in the production of the image-receiving sheet R1, except that the receptor layer was made to have the following composition.

| Receptor layer | |
|---|---|
| Polycarbonate resin (Trade name: LEXAN-141, manufactured by General Electric Corporation) | 90 parts by mass |
| Polyester resin (Trade name: Drapex429, manufactured by Witco) | 10 parts by mass |
| Amino-modified silicone (Trade name: X22-3050C, manufactured by Shin-Etsu Chemical Co., Ltd.) | 5 parts by mass |
| Epoxy-modified silicone (Trade name: X22-300E, manufactured by Shin-Etsu Chemical Co., Ltd.) | 5 parts by mass |
| Methylene chloride | 400 parts by mass |

(Image Formation)

An image of 152 mm×102 mm size was output by a thermal transfer printer A (DPB1500 (trade name) manufactured by Nidec Copal Corporation) or a thermal transfer printer B (the printer described in FIG. 6 of JP-A-5-278247) using the above-described ink sheets and the above-described image-receiving sheets. As for the printer A, a transport speed of the heat-sensitive transfer image-receiving sheet at the time of image formation was 73 mm/sec. As to the thermal transfer printer B, a print was performed setting a transport speed of the heat-sensitive image-receiving sheet at the time of image formation to 125 mm/sec or 150 mm/sec. Herein, the heat value released from the thermal head of the thermal transfer printer B was controlled so that the density gradation obtained by the thermal transfer printer B could become equal to the density gradation obtained by the thermal transfer printer A. Evaluation was performed by a Dmax print successively outputting ten sheets of black solid image.

In the above test, the welding and the ink peeling in the output image were evaluated according to the following criteria.

5: Neither welding nor ink peeling were found, and there was almost no blur.

4: A little blur was found, but neither welding nor ink peeling were found, and therefore there was no problem in practice.

3: Neither welding nor ink peeling were found, but clear blur was found, and therefore there was a problem in practice.

2: Both welding and ink peeling were found, but a print could be output from the printer.

1: The ink sheet and the image-receiving sheet were welding together, so that any print was not released from the printer.

The thus-obtained results were shown in Table 1 below.

TABLE 1

| Ink sheet | Image-receiving sheet | Printer A | Printer B |
|---|---|---|---|
| D1 | R1 | 4 | 2 |
| D2 | R1 | 3 | 2 |
| D1 | R2 | 4 | 3 |
| D2 | R2 | 3 | 2 |
| D3 | R1 | 3 | 2 |
| D3 | R2 | 5 | 5 |
| D4 | R2 | 5 | 4 |
| D5 | R2 | 5 | 5 |
| D6 | R2 | 5 | 5 |

From the Table 1 set forth above, it is recognized that combinations of the ink sheet and the image-receiving sheet according to the present invention were excellent in terms of no welding and no ink peeling, and that these advantages were remarkable in the case of a higher transport speed.

Example 2

(Production of an Ink Sheet 101)

A polyester film having 6.0 μm in thickness (trade name: Lumirror, manufactured by Toray Industries, Inc.) was used as the substrate film. The following yellow, magenta and cyan compositions were respectively applied as a monochromatic layer (coating amount: 1 g/m$^2$ when the layer was dried) on the front side of the film.

<Composition Solution for Dye Layer>

| Yellow composition | |
|---|---|
| Dye (7)-1 | 2.5 parts |
| Dye (8)-1 | 2.0 parts |
| Polyester 11 | 4.5 parts |
| Methyl ethyl ketone/toluene (1/1, at mass ratio) | 90 parts |

| Magenta composition | |
|---|---|
| Dye (9)-1 | 1.0 parts |
| Dye (10)-1 | 1.0 parts |
| Dye (11)-1 | 2.5 parts |
| Polyester 11 | 4.5 parts |
| Methyl ethyl ketone/toluene (1/1, at mass ratio) | 90 parts |

| Cyan composition | |
|---|---|
| Dye (12)-1 | 2.0 parts |
| Dye (13)-1 | 2.5 parts |
| Polyester 11 | 4.5 parts |
| Methyl ethyl ketone/toluene (1/1, at mass ratio) | 90 parts |

The composition of the above-described polyester 11 is set forth below.

Polyester 11

Polyester having a number-average molecular weight of 2,000, that was obtained by polymerizing the following molar ratio of acid and diol components as described below.

| | |
|---|---|
| Isophthalic acid | 5 |
| Terephthalic acid | 45 |
| Ethyleneglycol | 5 |
| Diethyleneglycol | 45 |

(Production of an Ink Sheet 102)

As a substrate film, there was used a 6.0 μm thick polyester film (Trade name: Lumirror, manufactured by Toray Industries, Inc.). On a back surface of the film, there was formed a heat-resistant sliding (smoothing) layer (thickness of dried film: 1.0 μm). The ink sheet 102 was prepared in the same manner as for sample 101, except for the above-described formulas.

<Coating Solution for Heat-Resistant Sliding Layer 1>

| | |
|---|---|
| Polyvinylbutyral resin (Trade name: S-LEC BX-1, manufactured by Sekisui Chemical Co., Ltd.) | 13.6 parts |
| Phosphoric ester (Trade name: PLYSURF, manufactured by DAI-ICHI KOGYOU SEIYAKU) | 0.8 parts |
| Methyl ethyl ketone | 42.9 parts |
| Toluene | 42.9 parts |

(Production of an Ink Sheet 103)

As a substrate film, there was used a 6.0 um thick polyester film (Trade name: Lumirror, manufactured by Toray Industries, Inc.). On a back surface of the film, there was formed a heat-resistant sliding layer (thickness of dried film: 1.0 μm). The ink sheet 103 was prepared in the same manner as for sample 101, except for the above-described formulas.

<Coating Solution for Heat-Resistant Sliding Layer 2>

| | |
|---|---|
| Polyvinylbutyral resin (Trade name: S-LEC BX-1, manufactured by Sekisui Chemical Co., Ltd.) | 13.6 parts |
| Polyisocyanate hardening agent (Trade name: Takenate D218, manufactured by Takeda Pharmaceutical Company Limited) | 0.6 parts |
| Phosphoric ester (Trade name: PLYSURF, manufactured by DAI-ICHI KOGYOU SEIYAKU) | 0.8 parts |
| Methyl ethyl ketone | 42.5 parts |
| Toluene | 42.5 parts |

(Production of Image-Receiving sheet 201)

Synthetic paper (trade name: Yupo FPG 200, manufactured by Yupo Corporation, thickness: 200 μm) was used as the support, and a receptor layer having the following composition was coated to one surface of this support. The coating was carried out such that the amount of the receptor layer was 4.0 g/m$^2$, and this layer was dried at 110° C. for 30 seconds.

-Composition of Coating Solution 1 for Receptor Layer-

| | |
|---|---|
| Polybutylacrylate (manufactured by Aldrich) | 30 parts |
| Polymethylmethacrylate (manufactured by Aldrich) | 70 parts |
| Amino-modified silicone (Trade name: X-22-343, manufactured by Shin-Etsu Chemical Co., Ltd.) | 3 parts |
| Epoxy-modified silicone (Trade name: KF-393, manufactured by Shin-Etsu Chemical Co., Ltd.) | 3 parts |
| Toluene/methyl ethyl ketone (1 part/1 part) | 500 parts |
| (Coating amount) 20 ml/m$^2$ | |

(Production of an Image-Receiving sheet 202)

An image-receiving sheet 202 was prepared in the same manner as for the image-receiving sheet 201, except that the coating solution 2 for the image-receiving sheet described below was used in place of the coating solution 1 for the image-receiving sheet described above.

-Composition of Coating Solution 2 for Receptor Layer-

| | |
|---|---|
| Polyester resin (Trade name: Vylon 200, manufactured by Toyobo Co., Ltd.) | 100 parts |
| Amino-modified silicone (Trade name: X-22-343, manufactured by Shin-Etsu Chemical Co., Ltd.) | 3 parts |
| Epoxy-modified silicone (Trade name: KF-393, manufactured by Shin-Etsu Chemical Co., Ltd.) | 3 parts |
| Toluene/methyl ethyl ketone (1 part/1 part) | 500 parts |
| (Coating amount) 20 ml/$m^2$ | |

(Production of an Image-Receiving Sheet 203)

An image-receiving sheet 203 was prepared in the same manner as for the image-receiving sheet 201, except that the coating solution 3 for the image-receiving sheet described below was used in place of the coating solution 1 for the image-receiving sheet described above.

-Composition of Coating Solution 3 for Receptor Layer-

| | |
|---|---|
| Polycarbonate resin (Trade name: LEXAN-141, manufactured by General Electric Corporation) | 30 parts |
| Polyester resin (Trade name: Vylon 200, manufactured by Toyobo Co., Ltd.) | 70 parts |
| Amino-modified silicone (Trade name: X-22-343, manufactured by Shin-Etsu Chemical Co., Ltd.) | 3 parts |
| Epoxy-modified silicone (Trade name: KF-393, manufactured by Shin-Etsu Chemical Co., Ltd.) | 3 parts |
| Methylene chloride | 500 parts |

(Image Formation)

An image of 152 mm×102 mm size was output by the thermal transfer printer A (DPB1500 manufactured by Nidec Copal Corporation) or the thermal transfer printer B (the printer described in FIG. 6 of JP-A-5-278247) using the above-described ink sheets and the above-described image-receiving sheets. A transport speed of the printer A was 73 mm/sec. As to the thermal transfer printer B, a transport speed of the heat-sensitive image-receiving sheet at the time of image formation was set to 125 mm/sec so as to perform the print. Herein, a heating value released from the thermal head of the thermal transfer printer B was controlled so that a density gradation obtained by the thermal transfer printer B could become equal to a density gradation obtained by the thermal transfer printer A. Ten sheets of black solid image were output successively. In the above test, generation of the welding and the ink peeling in the output image was evaluated according to the above-described criteria.

Besides, generation of wrinkles was evaluated according to the following criteria.

○: No generation of wrinkles was found.

Δ: Generation of a few of wrinkles was found.

x: Generation of a lot of wrinkles that would cause a practical problem was found.

(Test for Light Resistance (Fastness to Light))

Each of the above image samples was irradiated with xenon light (100,000 lx xenon light irradiator) through an ultraviolet cutting filter having a light transmittance of 50% for 370 nm light and a heat-ray cutting filter, for 14 days. The residual ratio of cyan after the irradiation at a portion, where the initial density of cyan had been 1.0, was calculated based on the following equation, to evaluate the light resistance according to the following criteria. As to the cyan densities, reflection densities were measured with a spectrophotometer (SpectroEye (trade name) manufactured by GretagMacbeth AG).

Residual ratio (%)=(Optical density after irradiation/Optical density before irradiation)×100(%)

◎: Average residual ratio was 80% or more.

○: Average residual ratio was 70% or more, and less than 80%.

Δ: Average residual ratio was 60% or more, and less than 70%.

x: Average residual ratio was less than 60%.

The obtained results are shown in Table 2.

TABLE 2

| | | Printer A | | | Printer B | | |
|---|---|---|---|---|---|---|---|
| Ink sheet No. | Image-receiving sheet No. | Welding etc. | Light resistance | Wrinkle Generation | Welding etc. | Light resistance | Wrinkle Generation |
| 101 | 201 | 3 | Δ | Δ | 1 | X | X |
| 102 | 201 | 4 | Δ | Δ | 2 | X | X |
| 103 | 201 | 4 | Δ | ○ | 4 | X | ○ |
| 101 | 202 | 4 | ○ | Δ | 3 | ○ | X |
| 102 | 202 | 5 | ○ | Δ | 3 | ○ | X |
| 103 | 202 | 5 | ○ | ○ | 5 | ○ | ○ |
| 101 | 203 | 4 | ◎ | Δ | 3 | ◎ | X |
| 102 | 203 | 5 | ◎ | Δ | 3 | ◎ | X |
| 103 | 203 | 5 | ◎ | ○ | 5 | ◎ | ○ |

From the above results of Table 2, it is found that combinations of the ink sheet and the image-receiving sheet as defined in the present invention was excellent in terms of welding etc., light resistance and generation of wrinkles, and that these advantages were remarkable in the case of a higher transport speed Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. § 119 (a) on Patent Application No. 2006-064934 filed in Japan on Mar. 9, 2006 and Patent Application No. 2006-

065173 filed in Japan on Mar. 10, 2006, each of which is entirely herein incorporated by reference.

What we claim is:

1. An image-forming method comprising the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals given from a thermal head, thereby to form an image;

(i) wherein the heat-sensitive transfer sheet comprises said thermal transfer layer that contains a thermally transferable color material and at least one polyester as a binder component of the thermal transfer layer, in which at least one-second by molar ratio of the acid component of said polyester is terephtharic acid; and (ii) wherein the heat-sensitive transfer image-receiving sheet comprises, on a support, said at least one receptor layer that contains at least one of polyester and/or polycarbonate polymers.

2. The image-forming method according to claim 1, wherein at least two-third by molar ratio of the acid component of said polyester is terephthalic acid.

3. The image-forming method according to claim 1, wherein at least three-fourth by molar ratio of the acid component of said polyester is terephthalic acid.

4. The image-forming method according to claim 1, wherein the heat-sensitive transfer sheet comprises at least one kind of a dye represented by formula (1) or (3):

Formula (1)

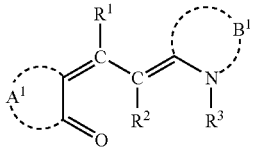

wherein, in formula (1), $R^1$, $R^2$ and $R^3$ each independently represent a hydrogen atom or a substituent; $A^1$ represents a group of atoms necessary to form a hetero ring together with the two carbon atoms; and $B^1$ represents a group of atoms necessary to form a hetero ring together with the carbon atom and the nitrogen atom; and Formula (3)

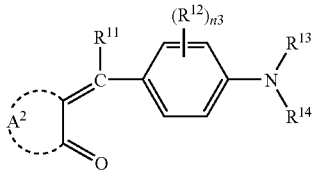

wherein, in formula (3), $R^{11}$, $R^{13}$ and $R^{14}$ each independently represent a hydrogen atom or a substituent; $R^{12}$ represents a substituent; $A^2$ represents a group of atoms necessary to form a hetero ring together with the two carbon atoms; and n3 represents an integer of 0 to 4.

5. The image-forming method according to claim 1, wherein the heat-sensitive transfer sheet comprises at least one kind of a dye represented by formula (4) or (5):

Formula (4)

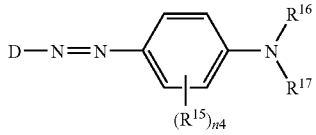

wherein, in formula (4), D represents an aromatic ring group or aromatic heterocyclic group originated from a diazonium salt; $R^{15}$ represents a substituent; $R^{16}$ and $R^{17}$ each independently represent a hydrogen atom or a substituent; and n4 represents an integer of 0 to 4; and Formula (5)

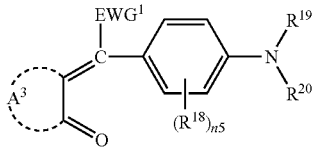

wherein, in formula (5), $A^3$ represents a group of atoms necessary to form a hetero ring together with the two carbon atoms; $EWG^1$ represents an electron-withdrawing group; $R^{18}$ represents a substituent; $R^{19}$ and $R^{20}$ each independently represent a hydrogen atom or a substituent; and n5 represents an integer of 0 to 4.

6. The image-forming method according to claim 1, wherein the heat-sensitive transfer sheet comprises at least one kind of a dye represented by formula (6):

Formula (6)

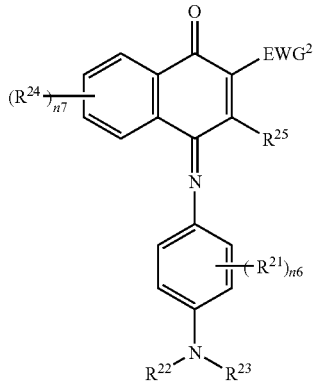

wherein, in formula (6), $EWG^2$ represents an electron-withdrawing group; $R^{21}$ and $R^{24}$ each independently represent a substituent; $R^{22}$, $R^{23}$ and $R^{25}$ each independently represent a hydrogen atom or a substituent; and n6 and n7 each independently represent an integer of 0 to 4.

7. The image-forming method according to claim 1, wherein the heat-sensitive transfer sheet comprises at least one kind of a dye represented by formula (1) or (3) as a yellow dye, at least one kind of a dye represented by formula (4) or (5) as a magenta dye, and at least one kind of a dye represented by formula (6) as a cyan dye:

Formula (1)

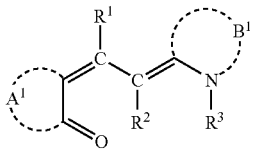

wherein, in formula (1), $R^1$, $R^2$ and $R^3$ each independently represent a hydrogen atom or a substituent; $A^1$ represents a group of atoms necessary to form a hetero ring together with the two carbon atoms; and $B^1$ represents a group of atoms necessary to form a hetero ring together with the carbon atom and the nitrogen atom;

Formula (3)

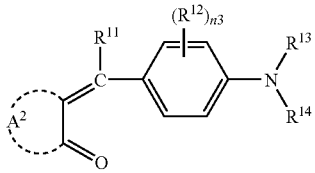

wherein, in formula (3), $R^{11}$, $R^{13}$ and $R^{14}$ each independently represent a hydrogen atom or a substituent; $R^{12}$ represents a substituent; $A^2$ represents a group of atoms necessary to form a hetero ring together with the two carbon atoms; and n3 represents an integer of 0 to 4;

Formula (4)

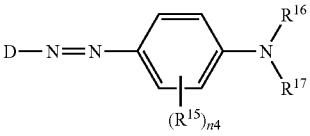

wherein, in formula (4), D represents an aromatic ring group or aromatic heterocyclic group originated from a diazonium salt; $R^{15}$ represents a substituent; $R^{16}$ and $R^{17}$ each independently represent a hydrogen atom or a substituent; and n4 represents an integer of 0 to 4;

Formula (5)

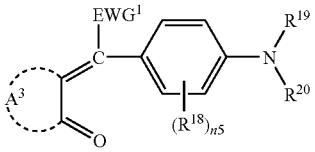

wherein, in formula (5), $A^3$ represents a group of atoms necessary to form a hetero ring together with the two carbon atoms; $EWG^1$ represents an electron-withdrawing group; $R^{18}$ represents a substituent; $R^{19}$ and $R^{20}$ each independently represent a hydrogen atom or a substituent; and n5 represents an integer of 0 to 4; and Formula (6)

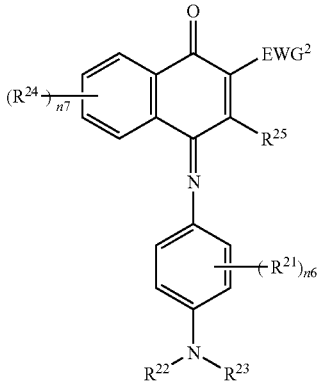

wherein, in formula (6), $EWG^2$ represents an electron-withdrawing group; $R^{21}$ and $R^{24}$ each independently represent a substituent; $R^{22}$, $R^{23}$ and $R^{25}$ each independently represent a hydrogen atom or a substituent; and n6 and n7 each independently represent an integer of 0 to 4.

8. The image-forming method according to claim 1, wherein a transport speed of the heat-sensitive transfer image-receiving sheet at the time of image-forming is 125 mm per second or more.

* * * * *